US011897659B2

(12) United States Patent
Sterling et al.

(10) Patent No.: US 11,897,659 B2
(45) Date of Patent: Feb. 13, 2024

(54) CONTAINER WITH A CAP

(71) Applicant: Henkel AG & Co. KGaA, Duesseldorf (DE)

(72) Inventors: Daniel Peter Sterling, Fairfield, CT (US); Keith Jon Colacioppo, Harrison, NY (US); Rainer Geberzahn, Jüchen (DE); Nicholas Robert Bull, Ridgefield, CT (US)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 17/945,744

(22) Filed: Sep. 15, 2022

(65) Prior Publication Data

US 2023/0020831 A1 Jan. 19, 2023

Related U.S. Application Data

(62) Division of application No. 16/949,484, filed on Oct. 30, 2020, now Pat. No. 11,554,899.

(51) Int. Cl.
*B65D 47/12* (2006.01)
*B65D 53/02* (2006.01)
(Continued)

(52) U.S. Cl.
CPC ..... *B65D 23/00* (2013.01); *B65D 41/0442* (2013.01); *B65D 41/0457* (2013.01); *B65D 2539/006* (2013.01)

(58) Field of Classification Search
CPC .. B65D 25/48; B65D 2539/006; B65D 53/02; B65D 41/26; B65D 47/40; B65D 47/068;
(Continued)

(56) References Cited

U.S. PATENT DOCUMENTS

RE28,874 E * 6/1976 Hammes ..... B65D 1/12 220/675
4,830,234 A * 5/1989 Odet ..... B65D 47/122 222/545
(Continued)

FOREIGN PATENT DOCUMENTS

EA 002750406 8/2017
EP 1120354 A1 8/2001
(Continued)

OTHER PUBLICATIONS

Extended European Search Report for Application No. EP21205154, European Patent Office, dated Jun. 20, 2022, 12 pages.

*Primary Examiner* — Allan D Stevens
(74) *Attorney, Agent, or Firm* — Sterne, Kessler, Goldstein & Fox P.L.L.C.

(57) ABSTRACT

A container assembly includes a container having a neck, a cap removably coupled to the neck, and a spout disposed in the neck. The cap includes an upper cap portion and a skirt configured to be received on a rim of the neck. The skirt includes a skirt sidewall and a skirt flange extending radially between a sidewall of the upper cap and the skirt sidewall. The spout includes a central duct extending through an opening of the neck and defining a pouring passage in communication with an interior of the container. The spout includes an outer sidewall extending around the central duct. The spout includes a seal ring disposed on an upper end of the outer sidewall of the spout. A bottom surface of the skirt flange is inclined downward in a direction toward the neck of the container at an angle between about 1° and about 10°.

6 Claims, 46 Drawing Sheets

(51) Int. Cl.
*B65D 23/00* (2006.01)
*B65D 41/04* (2006.01)

(58) Field of Classification Search
CPC ..... B65D 2543/00564; B65D 47/06; B65D 47/12; B65D 47/122; B65D 47/123; B65D 47/125; B65D 47/126; B65D 47/127; B65D 47/128; B65D 47/14; B65D 47/141; B65D 47/142; B65D 47/143; B65D 47/145; B65D 47/146; B65D 47/147; B65D 47/148
USPC ..... 222/569, 570, 109, 567
See application file for complete search history.

(56) References Cited

U.S. PATENT DOCUMENTS

| | | | | |
|---|---|---|---|---|
| 4,984,714 | A | 1/1991 | Sledge | |
| 5,058,772 | A | 10/1991 | Moore | |
| 5,101,993 | A | 4/1992 | Naim | |
| 5,108,009 | A * | 4/1992 | Davidson | B65D 41/265 222/571 |
| 5,921,432 | A * | 7/1999 | Van Berne | B65D 43/0218 220/795 |
| 6,708,839 | B2 * | 3/2004 | Diesterbeck | B65D 1/46 206/508 |
| 6,964,359 | B1 | 11/2005 | Darr | |
| 6,983,862 | B2 | 1/2006 | Nottingham | |
| 7,520,410 | B2 | 4/2009 | Gilbertson | |
| 10,005,214 | B1 * | 6/2018 | Varkey | B65D 23/065 |
| 2005/0103803 | A1 | 5/2005 | Hung | |
| 2005/0230440 | A1 | 10/2005 | Gilbertson | |
| 2016/0016681 | A1 * | 1/2016 | Heyn | B65D 41/18 53/471 |
| 2019/0031404 | A1 | 1/2019 | Henning | |
| 2019/0270553 | A1 | 9/2019 | Borger | |
| 2019/0293179 | A1 * | 9/2019 | Hiramatsu | F16K 15/026 |
| 2020/0062490 | A1 | 2/2020 | Baker | |
| 2021/0362919 | A1 | 11/2021 | Jelich | |

FOREIGN PATENT DOCUMENTS

| | | | |
|---|---|---|---|
| FR | 2655621 | A1 | 6/1991 |
| GB | 522566 | A * | 6/1940 |
| WO | 2017192861 | A1 | 11/2017 |
| WO | 2020163714 | A1 | 8/2020 |

* cited by examiner

CONTAINER WITH A CAP

CROSS-REFERENCE TO RELATED APPLICATIONS AND INCORPORATION BY REFERENCE

The present application is a divisional of U.S. patent application Ser. No. 16/949,484 filed Oct. 30, 2020, which is incorporated by reference herein in its entirety for all purposes.

FIELD OF THE INVENTION

The present disclosure relates to bottle closures, more specifically, caps (e.g., threaded caps) for sealing bottle openings and containing fluids dispensed from the bottles.

BACKGROUND OF THE INVENTION

Threaded caps are used in various industries as bottle closures. Threaded caps typically include a cylindrical-shaped wall and a thread disposed along the interior surface of the wall so that the cap may be securely received on a bottle neck via the application of torque. To ensure that threaded caps seal bottle openings reliably, the caps are designed to withstand impact forces that may dislodge and break the cap. One approach for strengthening the integrity of caps is limiting the caps' transverse dimension or a portion of the cap that rests above the end of the bottle neck (i.e., rest height).

Along with sealing the fluid held in the bottle, threaded caps may serve other purposes, such as receiving and holding a dosage of fluid dispensed from the bottle. Increasing the dosage capacity of the cap above the end of the bottle neck, however, may constrain the cap's impact tolerance, thereby compromising the cap's leak performance. Thus, threaded caps having larger dosage capacities have a tendency to break at the base of the upper area above the end of the bottle neck, even when exposed to minimal impact forces.

Some conventional threaded caps may also be used to enclose a dispenser received within a bottle neck. While having a dispenser disposed within a bottle neck may aid a user pouring liquid out of the bottle, the dispenser may disrupt proper placement of the seal between the bottle neck and the cap, thereby increasing the risk of leaking or unwanted rotational movement of the dispenser.

SUMMARY OF THE INVENTION

The present disclosure includes embodiments of caps and bottles having a container, a cap, and a spout.

In some embodiments, the bottle includes a container having a neck having a rim defining an opening into the container and a cap removably coupled to the neck. In some embodiments, the cap includes an upper cap portion having a top and a first sidewall extending around a perimeter of the top from the top to a lower end, a lower cap portion including a second sidewall coupled to the first sidewall and having a distal end. In some embodiments, the upper cap portion and the lower cap portion define a chamber extending along a longitudinal axis of the cap, and a skirt extending in a radial direction with respect to the longitudinal axis of the cap and configured to be received on the rim of the neck of the container. In some embodiments, the first sidewall includes a first transverse dimension at the lower end of the first sidewall, and the second sidewall includes a second transverse dimension less than the first transverse dimension.

In some embodiments, the lower end of the first sidewall is substantially aligned with the neck of the container when the cap is disposed on the container. In some embodiments, the top includes a third transverse dimension less than the first transverse. In some embodiments, the upper cap portion includes a plurality of convex-shaped protruded segments disposed circumferentially along the first sidewall. In some embodiments, the first side wall and the second sidewall are coupled by a transition region.

In some embodiments, the upper cap portion includes a plurality of complementary segments disposed circumferentially along the first sidewall and alternating with the plurality of protruded segments along an exterior of the first sidewall. In some embodiments, each complementary segment extends circumferentially along the exterior of the first sidewall at a fixed radius. In some embodiments, each protruded segment extends circumferentially along the exterior of the first sidewall at a variable radius greater than the fixed radius.

In some embodiments, the skirt includes a flange extending radially from the first sidewall and the second sidewall at an intersection disposed along the transition region. In some embodiments, the skirt comprises a third sidewall extending vertically around a perimeter of the flange. In some embodiments, the third sidewall comprises a fourth transverse dimension greater than the first transverse dimension of the first sidewall.

In some embodiments, the upper cap portion, the lower cap portion, and the skirt are comprised of a polymer material and integrally molded as a single piece. In some embodiments, the second sidewall includes the second transverse dimension along an entire length of the second sidewall. In some embodiments, the second sidewall extends through the opening of the neck when the cap is secured to the neck of the bottle. In some embodiments, the first sidewall is disposed above the rim of the neck when the cap is secured to the neck of the bottle.

In some embodiments, a cap for a bottle includes an upper cap portion having a top and a first sidewall extending around a perimeter of the top. In some embodiments, the first sidewall includes a plurality of polygonal segments disposed circumferentially along an exterior of the first sidewall to define a polygonal-shaped lateral cross-section.

In some embodiments, the first sidewall includes between 3 and 11 polygonal segments. In some embodiments, the plurality of polygonal segments extend entirely around the perimeter of the top. In some embodiments, the plurality of polygonal segments are curved. In some embodiments, the plurality of polygonal segments are straight. In some embodiments, the cap further includes a lower cap portion including a second sidewall extending from a lower end of the upper cap portion at a transition region. In some embodiments, the upper cap portion and the lower cap portion define a chamber extending along a longitudinal axis of the cap.

In some embodiments, the second sidewall is cylindrical. In some embodiments, the first sidewall includes a first transverse dimension at the lower end of the first sidewall. In some embodiments, the second sidewall includes a second transverse dimension less than the first transverse dimension. In some embodiments, the cap further includes a skirt. In some embodiments, the skirt includes a flange extending in a radial direction with respect to a longitudinal axis of the cap from the first sidewall and the second sidewall at an intersection disposed along the transition region. In some embodiments, the cap further includes a third sidewall extending vertically around a perimeter of the flange.

In some embodiments, a spout for a container includes a central duct defining a pouring passage configured to communicate with an interior of the container and extend through an opening of the container. In some embodiments, the spout includes an outer sidewall extending around the central duct. In some embodiments, the outer sidewall is configured to engage an interior surface of the container and having an upper end and a flange projecting in a radial direction from the upper end. In some embodiments, the spout includes a seal ring disposed on the flange of the outer sidewall. In some embodiments, the central duct and the outer sidewall include a first material having a first durometer and the seal ring includes a second material having a second durometer less than the first durometer.

In some embodiments, the central duct, the outer sidewall, and the seal ring are injected molded as a single integral element. In some embodiments, the seal ring is bonded to an upper surface of the flange of the outer sidewall of the spout. In some embodiments, the first material includes at least one of polyvinyl chloride, polyethylene, polypropylene, acrylic, polystyrene, polycarbonate, polyethylene terephthalate, and a polyethylene naphthalene. In some embodiments, the second material includes at least one of a thermoplastic elastomer, a silicon, and a rubber. In some embodiments, the seal ring includes an annular band portion and a lip projecting radially from an upper end of the annular band portion. In some embodiments, the annular band portion is configured to engage the interior surface of the container and the lip is configured to be received on a rim of the container. In some embodiments, the second durometer of the second material is in a range between about 10 shore and about 70 shore.

In some embodiments, the seal ring includes a static coefficient of friction slide angle in a range between about 50 degrees and about 70 degrees. In some embodiments, an interior surface of the seal ring is flush with an interior surface of the outer sidewall.

In some embodiments, a bottle includes a container having a neck defining an opening into the container, a cap removably coupled to the neck, and a spout disposed in the neck of the bottle. In some embodiments, the cap includes an upper cap portion having a top and an upper cap sidewall extending around a perimeter of the top, and a skirt configured to be received on a rim of the neck. In some embodiments, the skirt includes a skirt sidewall and a skirt flange extending radially between the upper cap sidewall and the skirt sidewall. In some embodiments, the spout includes a central duct extending through the opening of the neck and defining a pouring passage in communication with an interior of the container, an outer sidewall extending around the central duct and disposed against an interior surface of the neck, and a seal ring disposed on an upper end of the outer sidewall of the spout and disposed against the neck of the bottle. In some embodiments, the seal ring is disposed against the skirt flange of the cap when the cap is disposed on the container. In some embodiments, a bottom surface of the skirt flange is inclined downward in a direction toward the neck of the container at an angle between about 1° and about 10°.

In some embodiments, the seal ring includes an annular band portion and a lip projecting radially from an upper end of the annular band portion. In some embodiments, the annular band portion engages the interior surface of the neck of the container and the lip is received on an upper end of the neck. In some embodiments, the lip includes a first outer diameter, and the neck of the bottle includes a second outer diameter less than the first outer diameter. In some embodiments, the lip extends radially beyond an exterior surface of the neck by an overhang distance in a range between about 0.1 mm and about 2.0 mm. In some embodiments, the seal ring includes a projection extending from a top surface of the seal ring, and the projection engages the bottom surface of the skirt flange. In some embodiments, the projection of the seal ring includes an upper surface inclined in a direction toward the neck of the container.

In some embodiments, a bottle includes a container having a neck defining an opening into the container, and a spout disposed in the neck of the container. In some embodiments, the spout includes an outer sidewall defining an interior of the spout, a flange projecting radially outward from the outer sidewall, and a plurality of spout teeth extending from a bottom surface of the flange and disposed around a perimeter of the outer sidewall. In some embodiments, the neck of the container includes a plurality of neck teeth disposed along an interior surface of the neck and coupled with the spout teeth.

In some embodiments, the plurality of spout teeth include a plurality of ridges and grooves alternating around the perimeter of the outer sidewall, and the plurality of neck teeth include a plurality of ridges and grooves alternating around the interior surface of the neck. In some embodiments, the ridges of the spout teeth are received in the grooves of the neck teeth and the ridges of the neck teeth are received in the grooves of the spout teeth. In some embodiments, the plurality of spout teeth include a total number of teeth in a range between 10 teeth and 240 teeth. In some embodiments, the plurality of spout teeth and the plurality of neck teeth have a height in a range between about 0.25 mm and about 10 mm. In some embodiments, the plurality of spout teeth and the plurality of neck teeth each have a tooth face inclined with respect to a horizontal plane extending parallel to the flange at an angle in a range between about 2° and about 70°.

In some embodiments, a cap for a bottle includes an upper cap portion having a top and a first sidewall extending from the top. In some embodiments, the upper cap portion includes a plurality of protruded segments disposed circumferentially along an exterior of the first sidewall, in which each protruded segment includes an edge protruding radially from the first sidewall in an axial direction and in a circumferential direction.

In some embodiments, the cap includes a lower cap portion, in which the upper cap portion and lower cap portion define a chamber extending along a longitudinal axis of cap. In some embodiments, the lower cap portion includes a second sidewall disposed concentrically with respect to the first sidewall and a distal end defining an opening into the chamber. In some embodiments, the cap includes a skirt extending radially with respect to the longitudinal axis of the cap, and the skirt includes a skirt sidewall. In some embodiments the skirt sidewall is disposed concentrically with respect to the first sidewall and the second sidewall. In some embodiments, an interior surface of the skirt is configured to engage an exterior surface of the bottle to secure the cap to the bottle.

In some embodiments, the skirt includes a flange extending between the first sidewall and the skirt sidewall. In some embodiments, the flange and an end of the first sidewall merge at an intersection disposed along a transition region of the cap. In some embodiments, the flange delineates the boundary between the upper cap portion and the lower cap portion. In some embodiments, the flange extends radially from the upper cap portion. In some embodiments, the flange extends radially from the lower cap portion.

In some embodiments, the upper cap portion includes a plurality of complementary segments disposed circumferentially along the first sidewall and alternating with the plurality of protruded segments along the exterior of the first sidewall, with each complementary segment extending circumferentially along the exterior of the first sidewall at a fixed radius and each protruded segment extending circumferentially along the periphery of first sidewall at a variable radius greater than the fixed radius. In some embodiments the first sidewall may have segments that are of any shape and number.

In some embodiments, the upper cap portion has a first transverse dimension, and the lower cap portion has a second transverse dimension less than the first transverse dimension of the upper cap portion. In some embodiments, the skirt has a third transverse dimension greater than the first transverse dimension of the upper cap portion. In some embodiments, the top has a fourth transverse dimension less than, equal to or greater than the second transverse dimension of the lower cap portion.

In some embodiments, the upper cap portion has a first lateral profile that is asymmetrical, and the second sidewall has a second lateral profile that is symmetrical. In some embodiments, the first lateral profile of the upper cap portion has an irregular-polygonal contour. In some embodiments, a lower end of the first sidewall is configured to be substantially aligned with a neck of the bottle when secured to the bottle. In some embodiments, the first sidewall has an arch-shaped longitudinal profile curving outward from the longitudinal axis of the cap.

In some embodiments, the cap includes a lower cap portion, and the upper cap portion and lower cap portion define a chamber extending along a longitudinal axis of the cap. In some embodiments, the lower cap portion includes a second sidewall disposed concentrically with respect to the first sidewall and a distal end defining an opening into the chamber.

In some embodiments, the first sidewall of upper cap portion curves outward from the longitudinal axis of the cap, and an intersection between first sidewall and the top has a rounded edge.

In some embodiments, the lower cap portion has a second sidewall disposed concentrically with respect to the first sidewall and a distal end defining an opening into the chamber.

In some embodiments, the neck includes a rim having a transverse dimension, and the upper portion includes a lower end having a transverse dimension corresponding to the transverse dimension of neck.

BRIEF DESCRIPTION OF THE DRAWINGS

The accompanying drawings, which are incorporated herein and form a part of the specification, illustrate the embodiments and, together with the description, further serve to explain the principles of the embodiments and to enable a person skilled in the relevant art(s) to make and use the embodiments.

Figure 1:
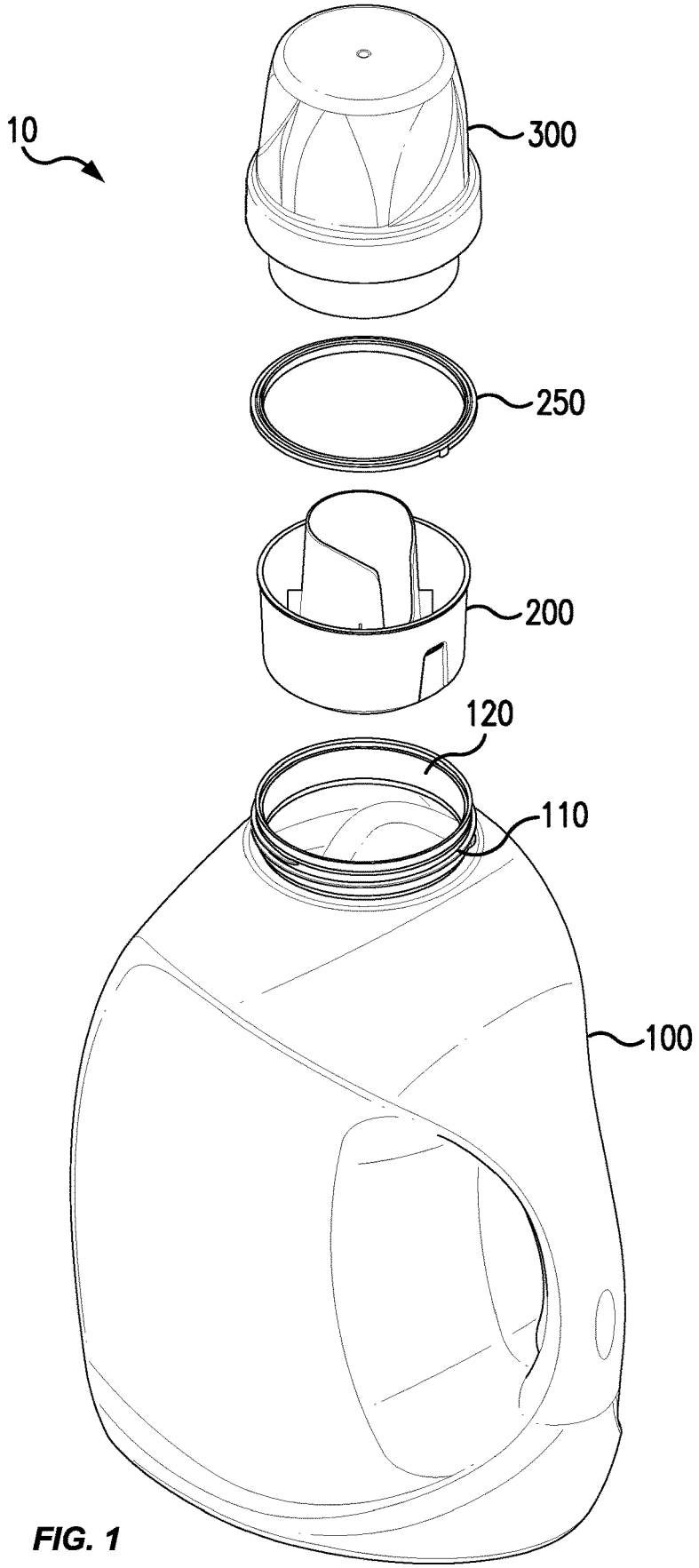
FIG. 1 is an exploded view of a bottle assembly, according to an embodiment.

The features and advantages of the embodiments will become more apparent from the detailed description set forth below when taken in conjunction with the drawings, in which like reference characters identify corresponding elements throughout. In the drawings, like reference numbers generally indicate identical, functionally similar, and/or structurally similar elements.

DETAILED DESCRIPTION OF THE INVENTION

Embodiments of the present disclosure are described in detail with reference to embodiments thereof as illustrated in the accompanying drawings. References to "one embodiment," "an embodiment," "some embodiments," etc., indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The term "about" or "substantially" or "approximately" as used herein refer to a considerable degree or extent. When used in conjunction with, for example, an event, circumstance, characteristic, or property, the term "about" or "substantially" or "approximately" can indicate a value of a given quantity that varies within, for example, 1-15% of the value (e.g., ±1%, ±2%, ±5%, ±10%, or ±15% of the value), such as accounting for typical tolerance levels or variability of the embodiments described herein.

The following examples are illustrative, but not limiting, of the present embodiments. Other suitable modifications and adaptations of the variety of conditions and parameters normally encountered in the field, and which would be apparent to those skilled in the art, are within the spirit and scope of the disclosure.

While threaded caps have been used in various industries, such as dispensing bottles, threaded caps tend to have limited dimensions and rest height above the bottle opening so that the cap may withstand strong impact forces (e.g., falling from a height). However, limiting the cap's dimensions and rest height curtails the dosage capacity of the cap. Thus, there is a need for a cap that may withstand strong impact forces, reliably seal the bottle opening, and also collect a greater dosage of fluid dispensed from the bottle by extending above the end of the bottle neck.

The upper portion extending above the end of the bottle neck may be cylindrical in order to maximize dosage capacity for a given rest height, however a cylindrical shape does not deflect or absorb impact forces as well as an arched shape. Therefore, a tapered top portion with a curved side wall would be the best configuration to withstand impact forces. This however creates a configuration in which the dimension of the top of the upper portion of the cap may be small enough to fit inside of the distal opening end of the lower portion of another of the same cap.

In addition, multiple threaded caps may be tumble packed or stacked together during transit prior to assembly with a bottle. When stacked together, the lower sidewalls of a top cap may form a vacuum seal with the top outer sidewalls of a bottom cap, such that the top cap is nested on the bottom cap. Consequently, a handler must apply a significant amount of force to separate the nested caps, thereby rendering the assembly of the caps cumbersome. Accordingly, there is a need for an improved cap that may be easily separated from other stacked caps during assembly.

Conventional dispensing bottles usually include a dispenser member received within the neck of the bottle to concentrate and direct liquid being poured out of the neck of the bottle. Seals, such as gaskets, may be used to isolate the bottle reservoir from the interface between the cap and the combination of the dispenser and the bottle neck. However, conventional seals are typically installed separately from the spout. Separately installing the seal gasket from the spout hinders proper placement of the seal along the interface between the cap and the combination of the bottle neck and the dispenser, which can pose higher risk of leaks and unwanted rotation of the dispenser within the bottle neck.

According to embodiments described herein, the caps and bottles of the present disclosure may overcome one or more of the deficiencies noted above by having an upper cap portion configured to enclose an opening of a bottle neck and hold a dosage of fluid, a lower cap portion configured to extend into the bottle neck and increase the dosage capacity and pour cleanliness and convenience of the cap, and a skirt configured to engage the exterior surface of the bottle neck to secure the cap to the bottle. The upper cap portion may include a first sidewall with one or more sections that protrude radially away from other portions of first sidewall, so that the dosage capacity of cap may be increased and that stacked caps may be easily separated during shipping and assembly. The skirt may include a flange having a bottom surface that is inclined in a direction toward a neck of the bottle to deflect the seal ring in a radial direction, as the cap is secured to the neck of the bottle, thereby providing a proper seal between the neck of the bottle and the interior surface of the skirt.

According to embodiments described herein, the spouts of the present disclosure may overcome one or more of the deficiencies noted above by including a central duct, an outer sidewall extending around the central duct, and a seal ring disposed on a flange of the outer sidewall. The central duct and the outer sidewall may be comprised of a first material having a first durometer, and the seal ring may be comprised of a second material having a second durometer less than the first durometer. The central duct, the outer sidewall, and the seal ring may be injected molded as a single integral element so that the seal ring and the spout may be installed into the neck of a bottle simultaneously, providing proper placement of the seal ring with respect to the cap and the bottle neck.

According to embodiments described herein, the bottle assembly of the present disclosure may overcome one or more of the deficiencies noted above by including a plurality of neck teeth disposed along an interior surface of the neck and coupled with the spout teeth and a plurality of spout teeth extending around a perimeter of a spout. The plurality of spout teeth may be configured to couple with the plurality of neck teeth so that the spout remains fixed within the neck of the bottle, even when exposed to high torque forces applied by a user twisting a cap onto the neck of the bottle.

Figure 2:
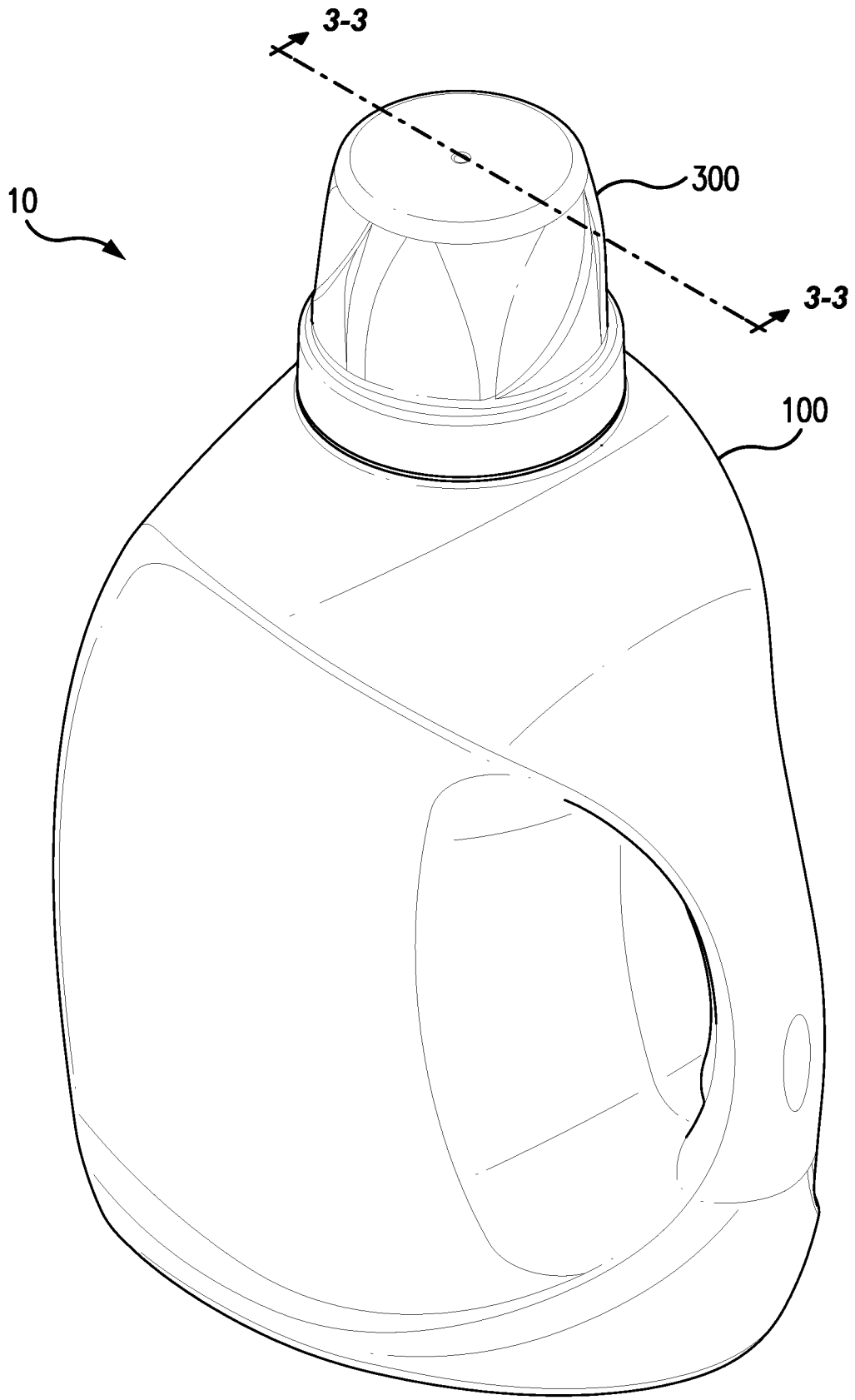
FIG. 2 is a perspective view of a bottle assembly with a cap fastened to the bottle, according to an embodiment.
Figure 3:
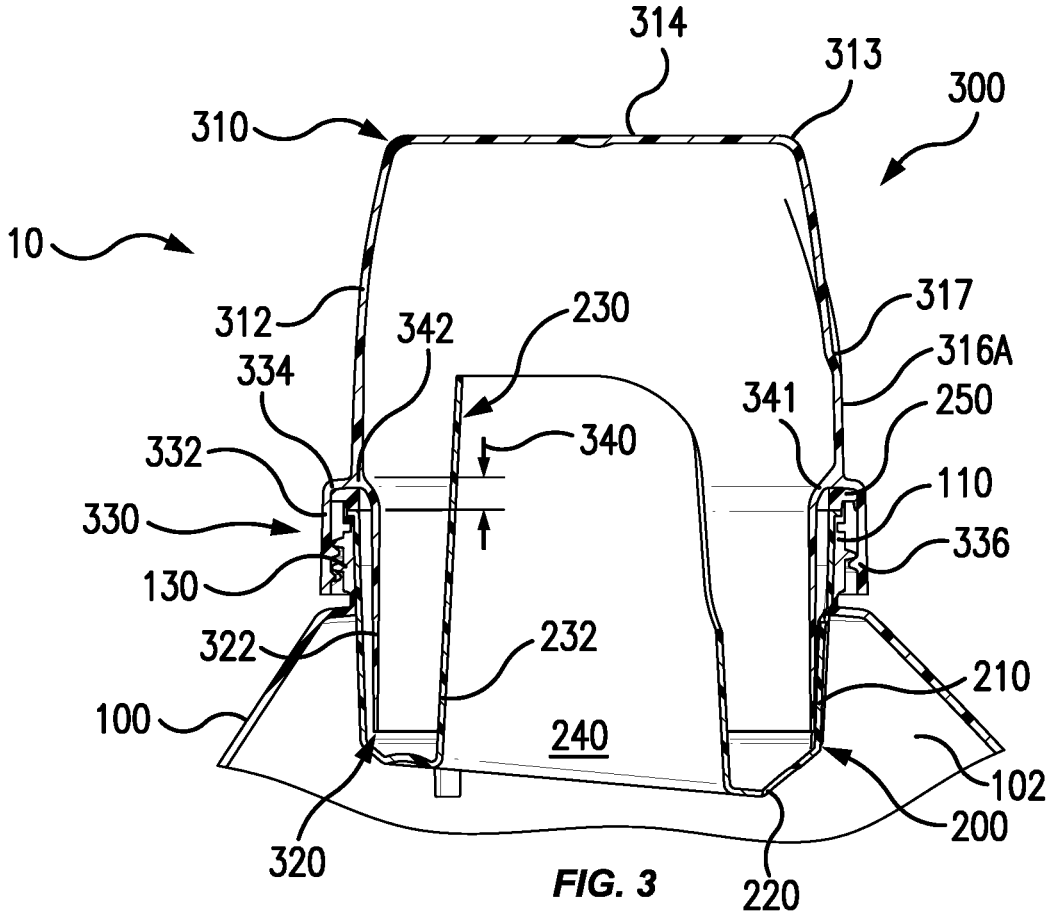
FIG. 3 is a side cross sectional view of a bottle assembly with a cap secured to a neck of a bottle taken along line 3-3 of FIG. 2, according to an embodiment.

Embodiments will now be described in more detail with reference to the figures. With reference to FIGS. 1-3, for example, in some embodiments, a bottle assembly 10 may include a bottle 100, a spout 200 with a seal ring 250, and a cap 300. In certain embodiments, bottle 100 may define a reservoir 102 for storing a fluid therein and may comprise a neck 110 projecting from a top surface of bottle 100 and defining an opening 120 into reservoir 102. In certain embodiments, spout 200 may be disposed in neck 110 of bottle 100 and may be configured to direct fluid received from reservoir 102 through opening 120 without allowing dispensed fluid to accumulate around neck 110. In certain embodiments, cap 300 may be configured to be removably coupled to neck 110 of bottle 100 to seal fluid stored in reservoir 102 of bottle 100 and be removed from neck 110 of bottle 100 to receive a dosage of fluid poured out of reservoir 102 of bottle 100.

Figure 4:
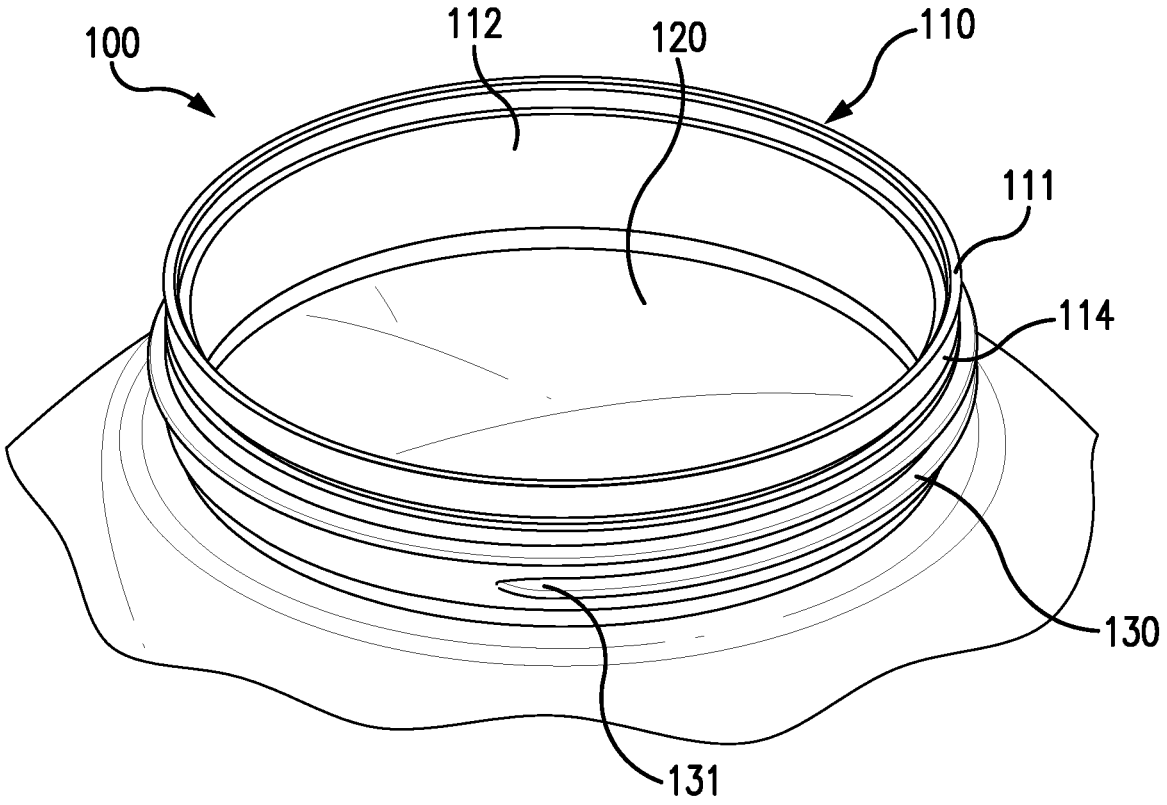
FIG. 4 is a perspective view of a neck defining an opening into a bottle, according to an embodiment.

Referring to FIG. 4, for example, in certain embodiments, bottle 100 may include thread 130 winding circumferentially along an exterior surface 114 of neck 110. In some embodiments, thread 130 may have a leading end disposed proximate to a rim 111 of neck 110 and a trailing end 131 disposed below the leading end of the thread 130 in an axial direction.

Figure 5:
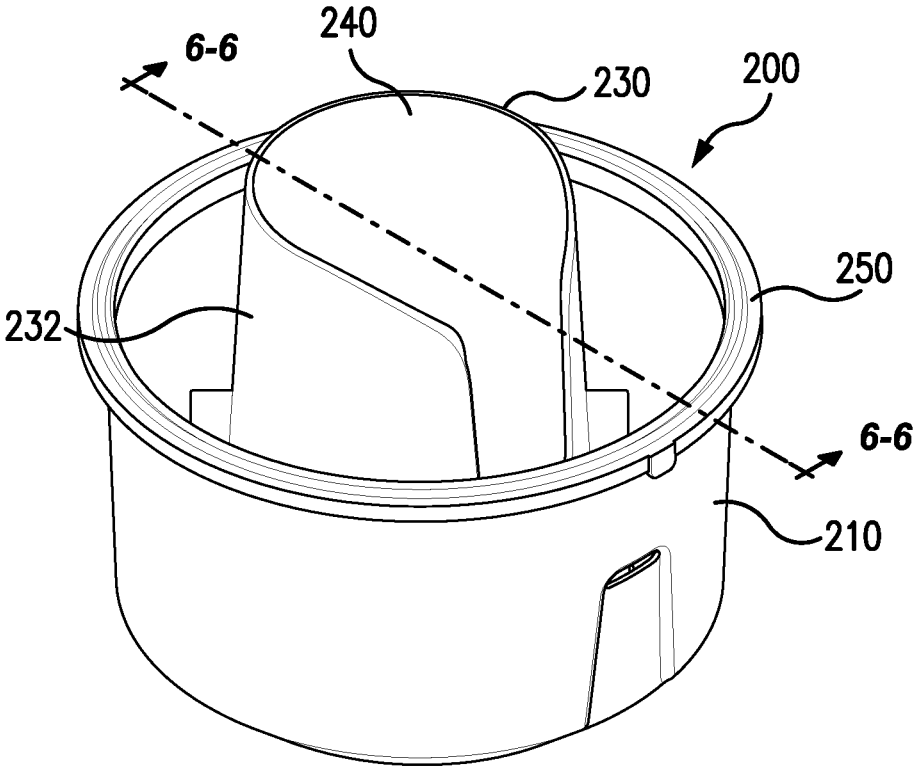
FIG. 5 is perspective view of a spout with a seal ring, according to an embodiment.
Figure 6:
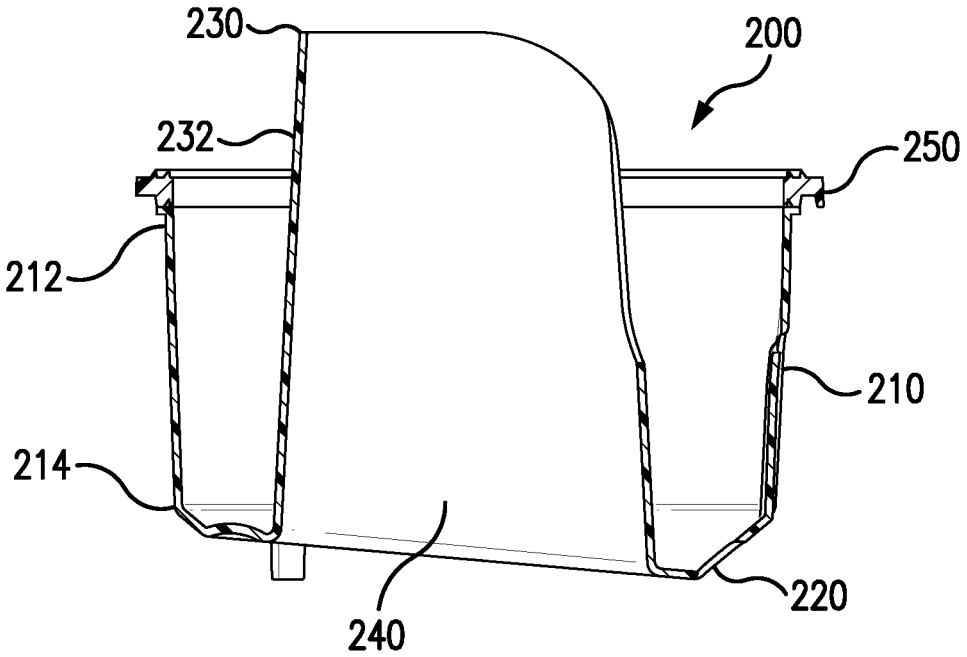
FIG. 6 is a cross-sectional view of the spout taken along line 6-6 of FIG. 5, according to an embodiment.

Referring to FIGS. 5 and 6, for example, in certain embodiments, spout 200 may comprise an outer sidewall 210 and a bottom wall 220 integrally connected to outer sidewall 210 to form a cup-shaped body. In some embodiments, spout 200 may comprise a central duct 230 defining a pouring passage 240 opening through the bottom wall 220. In some embodiments, outer sidewall 210 may extend around central duct 230, and bottom wall 220 extends from central duct 230 to outer sidewall 210. In some embodiments, central duct 230 may extend beyond an upper end 212 of outer sidewall 210. In certain embodiments, central duct 230 may comprise a cylindrical-shaped wall 232 extending from bottom wall 220 and beyond rim 111 of neck 110 to define pouring passage 240. In certain embodiments, seal ring 250 may be coupled to upper end 212 of outer sidewall 210.

In certain embodiments, spout 200 may be configured to be received within neck 110 and secured to bottle 100. As shown in FIG. 3, for example, when spout 200 is secured to bottle 100, outer sidewall 210 may be disposed proximate to or against an interior surface 112 of neck 110. In some embodiments, upper end 212 of outer sidewall 210 may be disposed proximate to rim 111 of neck 110 and seal ring 250 may be received over rim 111 of neck 110. Outer sidewall 210 may extend into reservoir 102, where bottom wall 220 may extend radially from a lower end 214 of outer sidewall 210 to partially enclose a lower section of reservoir 102 from opening 120 of neck 110. Wall 232 of central duct 230 may extend beyond rim 111 of neck 110, where pouring passage 240 is in communication with reservoir 102 of bottle 100.

In certain embodiments, outer sidewall 210, bottom wall 220, and central duct 230 of spout 200 may be comprised of a first material, for example, polyvinyl chloride, high and low density polyethylene, polypropylene, acrylic, polystyrene, polycarbonate, polyethylene terephthalate, polyethylene naphthalene and blends of thereof. In certain examples, seal ring 250 may be comprised of a second material, for example, a thermoplastic elastomer (TPE), foamed polyethylene, a rubber-based material, LDPE, wax, an adhesive, or blends thereof. In certain examples, seal ring 250 may be integrally attached to upper end 212 of outer sidewall 210 by a molding process such that seal ring 250 and cup-shaped body of spout 200 form a single piece.

Figure 7:
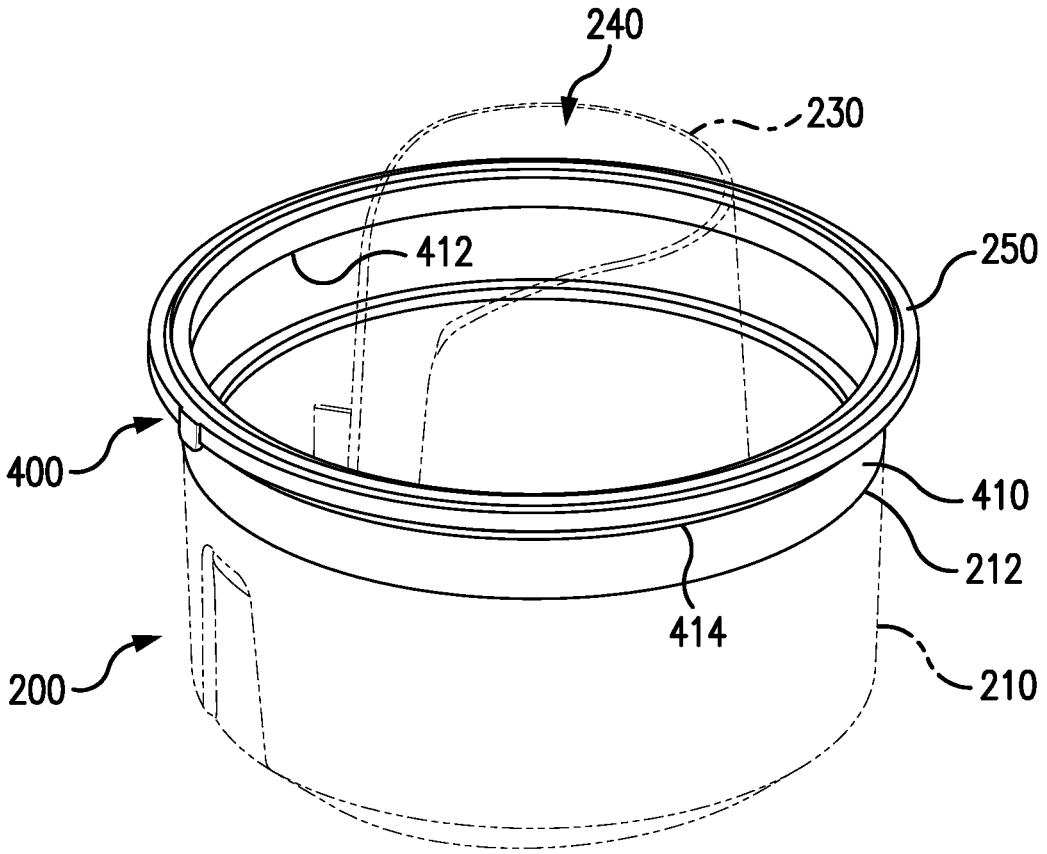
FIG. 7 is a perspective view of a spout with an insert, according to an embodiment.
Figure 8:
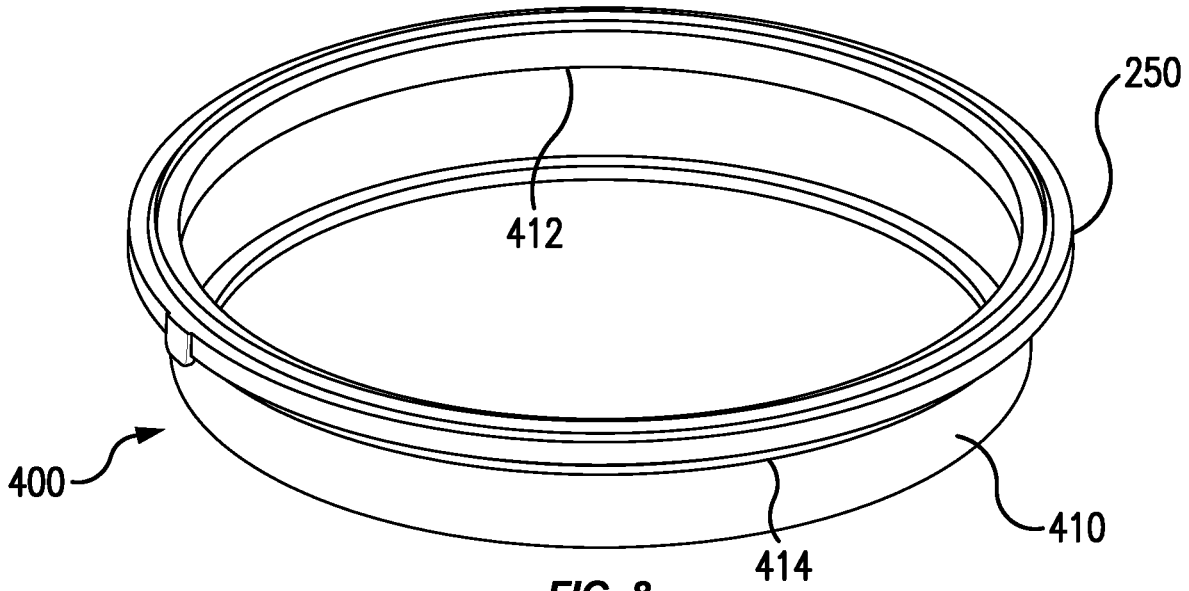
FIG. 8 is a perspective view of an insert, according to an embodiment

In certain embodiments, as shown in FIGS. 7 and 8, for example, spout 200 may include an insert 400 and/or seal ring 250 integrated as a single element. In some embodiments, insert 400 may include a cylindrical-shaped vertical side wall 410 and a horizontal flange 414 disposed at a first end 412 of sidewall 410. In some embodiments, vertical sidewall 410 may be disposed on upper end 212 of outer sidewall 210 and extend continuously with respect to outer sidewall 210. In certain embodiments, seal ring 250 may be coupled to first end 412 of sidewall 410. In certain embodiments, insert 400 may be comprised of a first material, such as for example, polyvinyl chloride, high or low density polyethylene (HDPE, LDPE), polypropylene, acrylic, polystyrene, polycarbonate, polyethylene terephthalate, polyethylene naphthalene and blends of thereof. In certain embodiments, insert 400 may be integrally attached to upper end 212 of outer sidewall 210 by a molding process such that seal ring 250, cup-shaped body of spout 200, and insert 400 form a single element.

Figure 9:
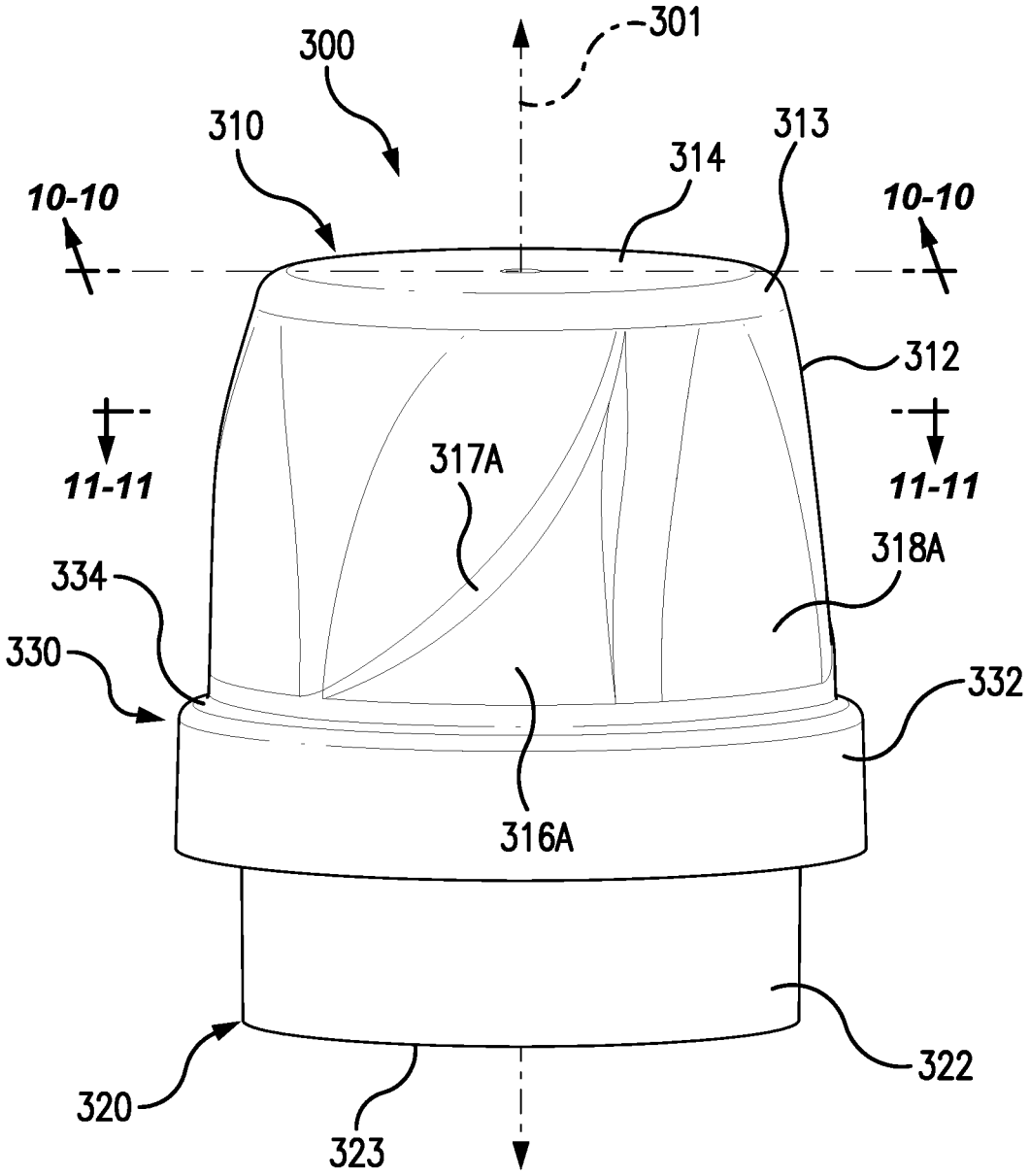
FIG. 9 is a perspective view of a cap, according to an embodiment.
Figure 10:
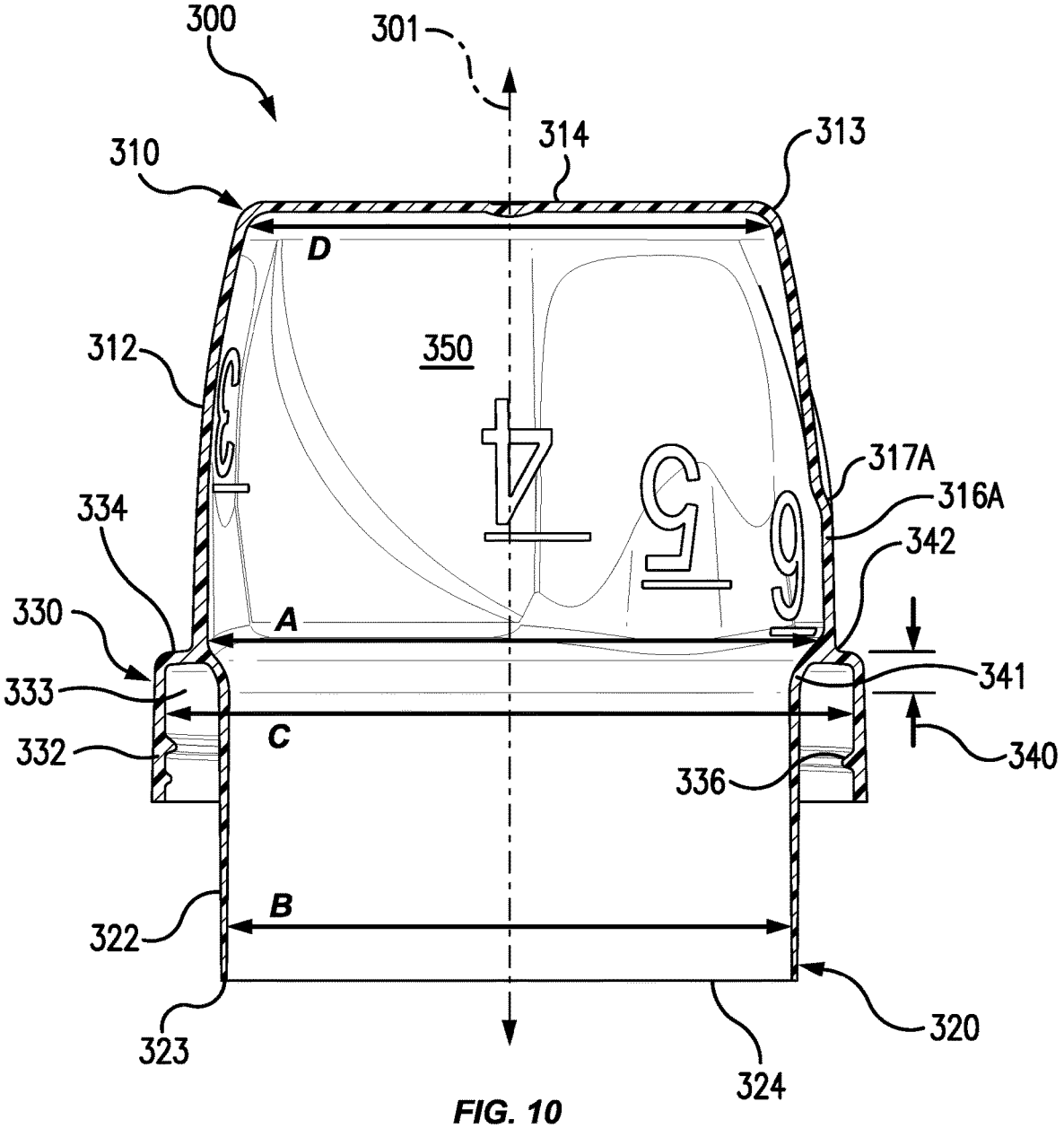
FIG. 10 is a side cross-sectional view of a cap taken along line 10-10 of FIG. 9, according to an embodiment.
Figure 11:
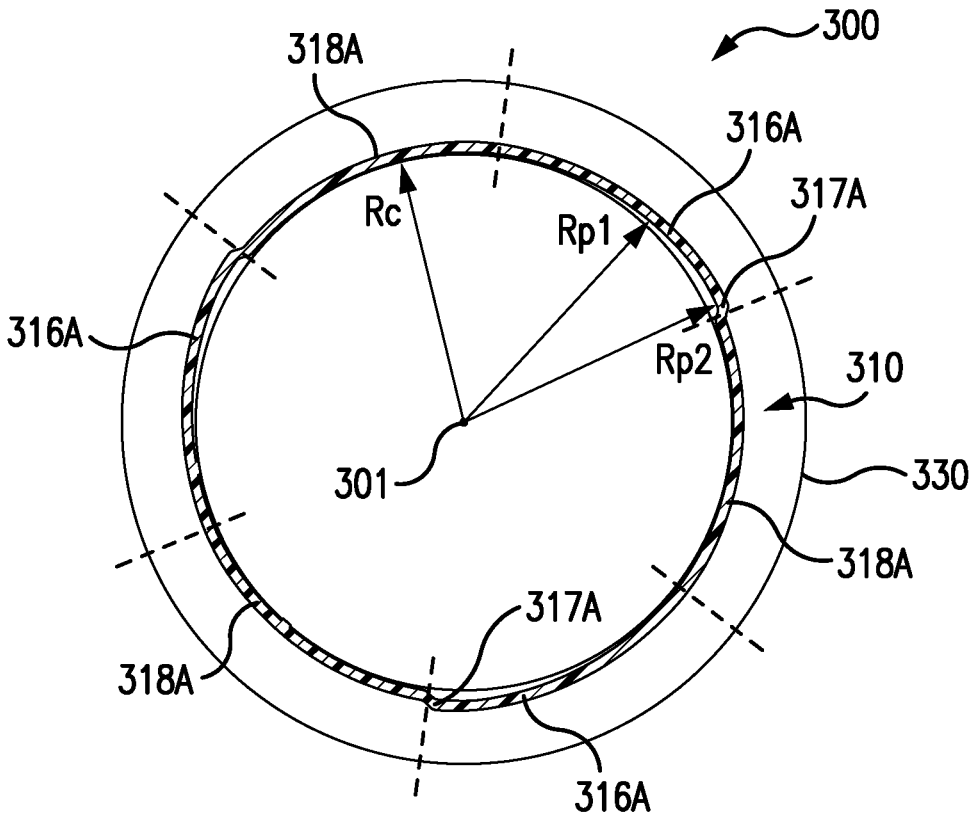
FIG. 11 is a top cross-sectional view of a cap taken along line 11-11 of FIG. 9, according to an embodiment.
Figure 12A:
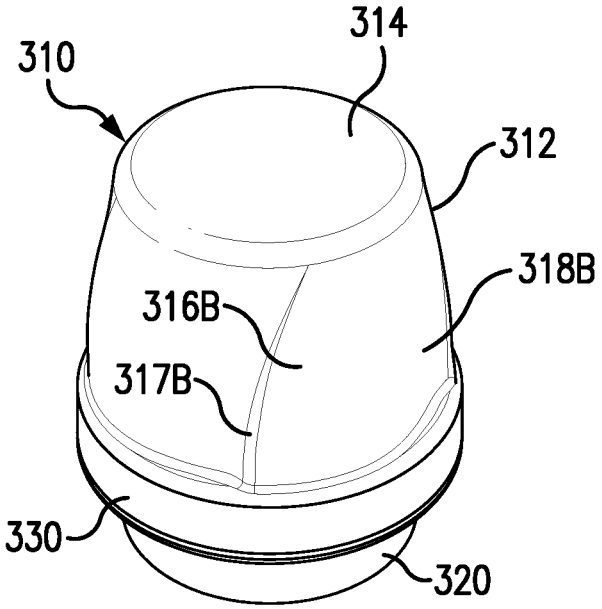
FIG. 12A is a perspective view of a cap, according to an embodiment.
Figure 12B:
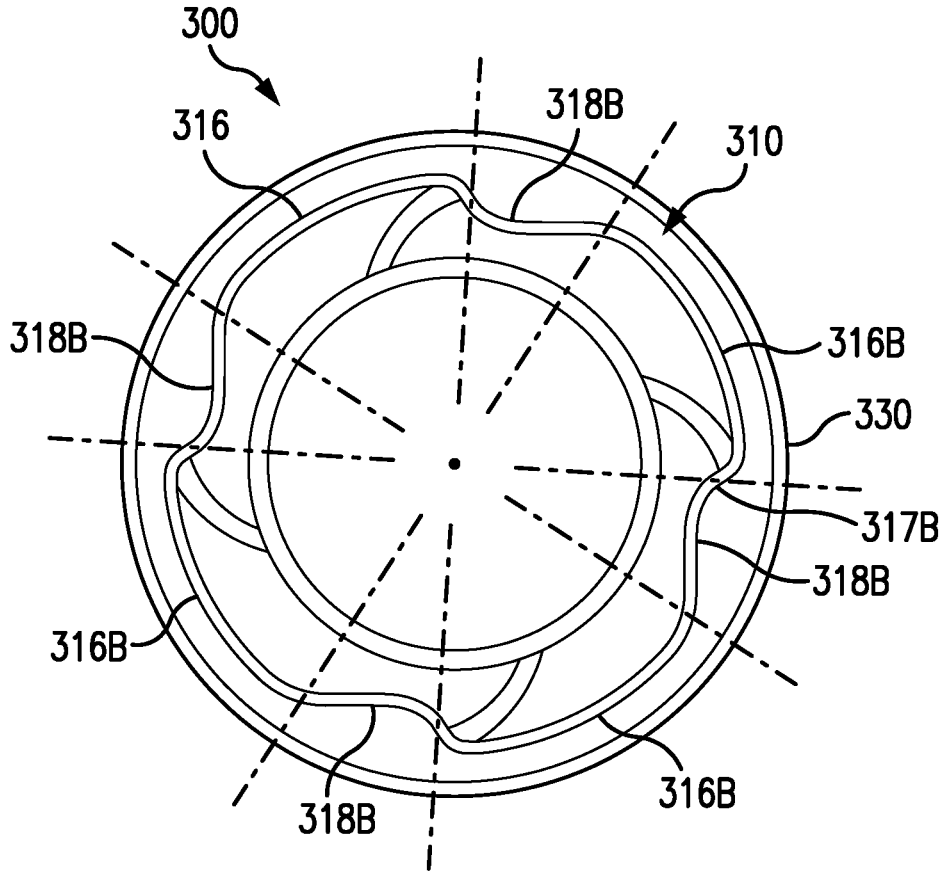
FIG. 12B is a plan view of a cap according to an embodiment.
Figure 12C:
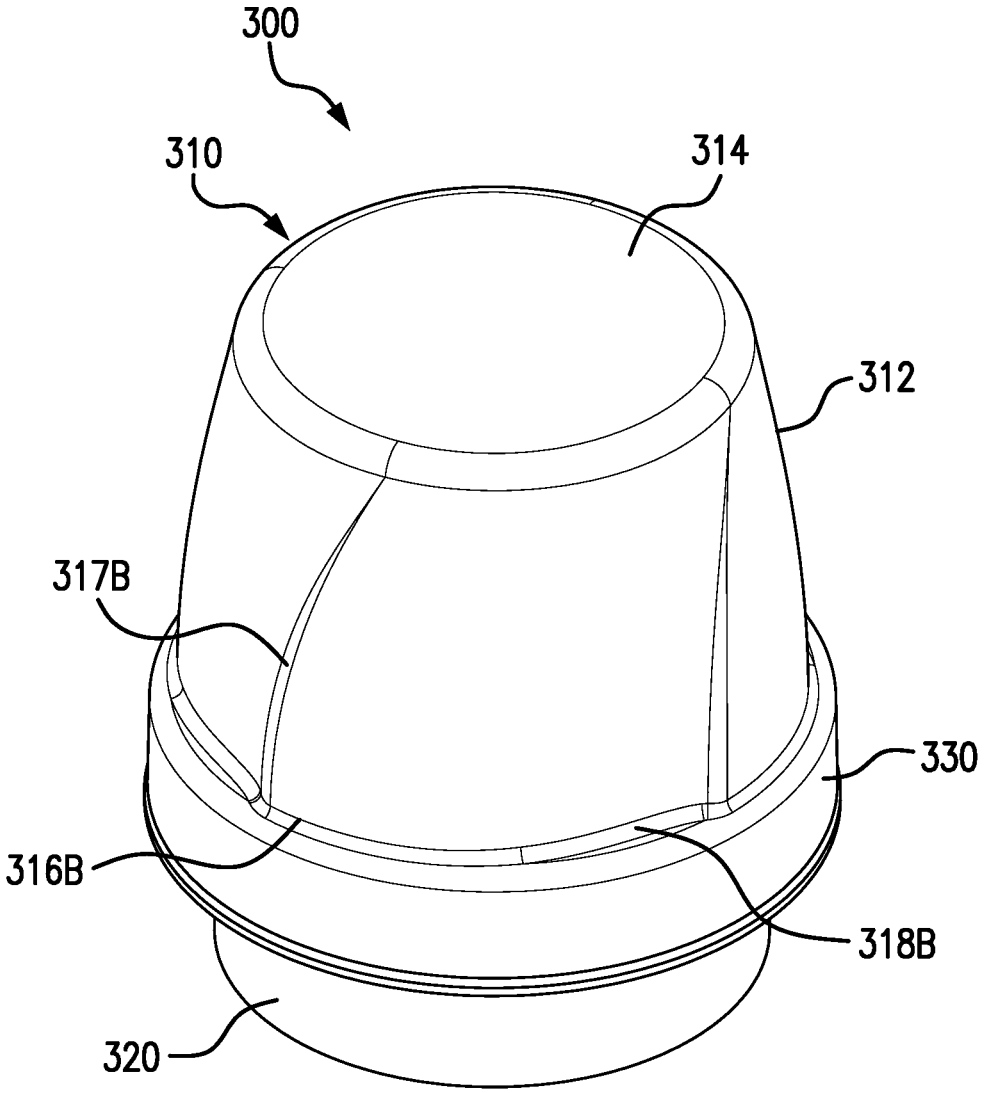
FIG. 12C is a top perspective view of a cap, according to an embodiment.
Figure 12D:
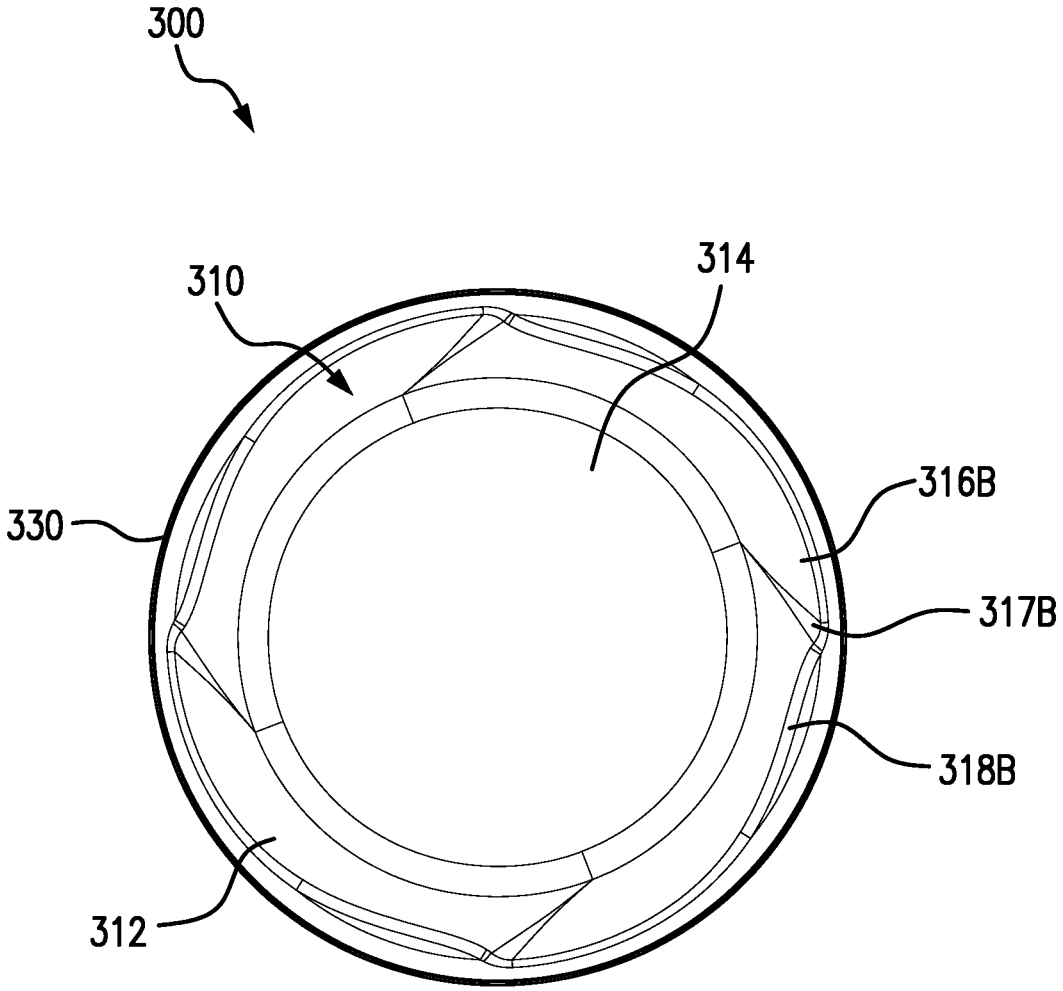
FIG. 12D is a plan view of a cap, according to an embodiment.
Figure 12E:
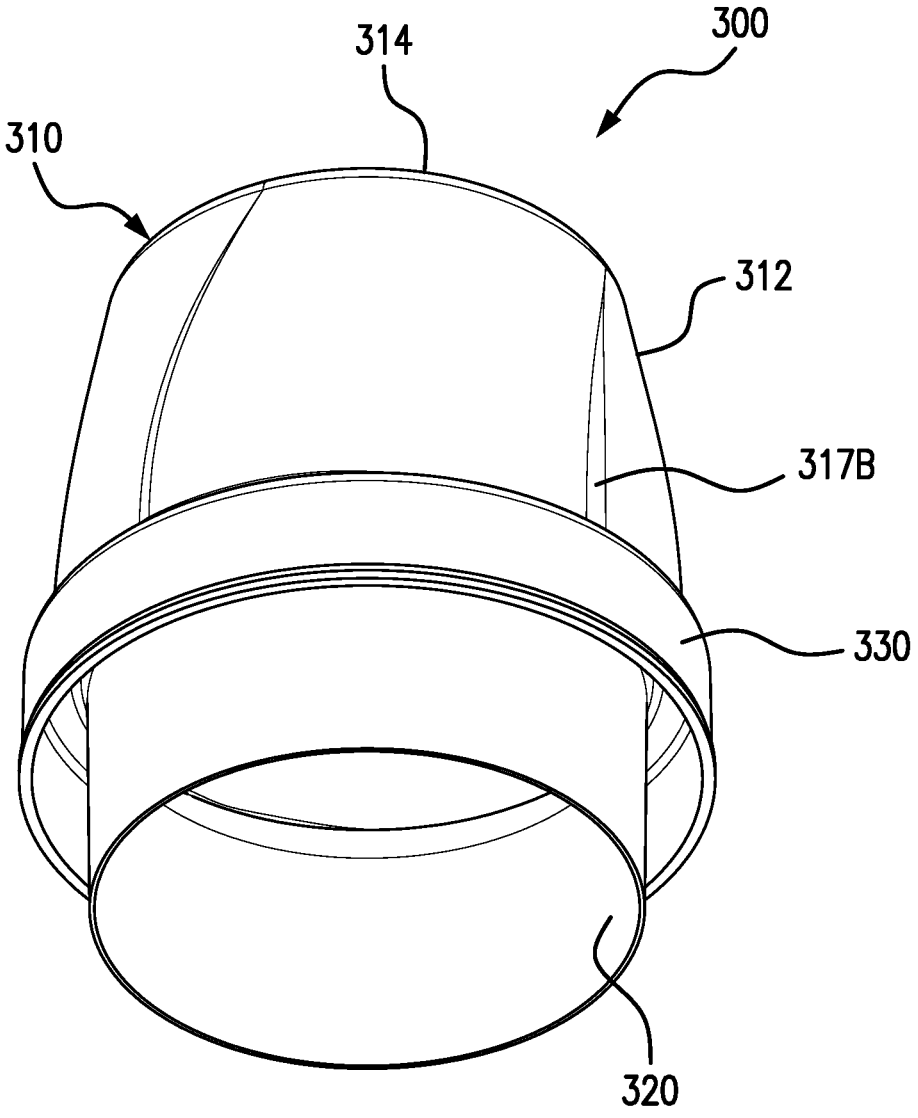
FIG. 12E is a bottom perspective view of a cap, according to an embodiment.

Referring to FIGS. 9-11, for example, in certain embodiments, cap 300 may comprise an upper cap portion 310 configured to enclose opening 120 of neck 110 and hold a dosage of fluid, a lower cap portion 320 configured to extend into neck 110 and increase dosage capacity of cap 300, and a skirt 330 configured to engage exterior surface 114 of neck 110 to secure cap 300 to bottle 100. In certain embodiments, upper cap portion 310, lower cap portion 320, and skirt 330 may be integrally formed as a single piece by a molding process. In one example, the molding process may include using a collapsible core to increase the diameter of the upper cap portion 310 (e.g., transverse dimension A shown in FIG. 10). In certain embodiments, upper cap portion 310, lower cap portion 320, and skirt 330 may be comprised of a polymer material, for example, polyvinyl chloride, high and low density polyethylene, polypropylene, acrylic, polystyrene, polycarbonate, polyethylene terephthalate, polyethylene naphthalene, copolymers, and blends thereof.

In certain embodiments, as shown, for example, in FIG. 10, upper cap portion 310 and lower cap portion 320 may be connected at a transition region 340 of cap 300 to define a chamber 350 extending along a longitudinal axis 301 of cap 300. Cap 300 may be configured to receive and hold fluid poured from reservoir 102 of bottle 100 in chamber 350. In certain embodiments, upper cap portion 310 may comprise a top 314 and a first sidewall 312 extending around a perimeter of top 314 to transition region 340. In some embodiments, first sidewall 312 may comprise a lower end disposed at an intersection 342 disposed along transition region 340. In certain embodiments, lower cap portion 320 may comprise a second sidewall 322 extending from transition region 340 and a distal end 323 defining an opening 324 into chamber 350. In certain embodiments, second sidewall 322 of lower cap portion 320 may be disposed concentrically with respect to first sidewall 312 of upper cap portion 310. In certain embodiments, transition region 340 may comprise a rim wall 341 extending from intersection 342 to an end of second sidewall 322.

In some embodiments, upper cap portion 310 may include one or more sections (e.g., protruded segments 316A-B and polygonal segments 319A-D) of first sidewall 312 that extend or protrude radially away from other portions of first sidewall 312, breaking or disrupting the circumference of first sidewall 312 of upper cap portion 310, so that the dosage capacity of cap 300 may be increased, and preventing a vacuum seal when stacked with other caps 300, so that stacked caps 300 may be easily separated during shipping and assembly.

For example, in some embodiments, as shown by way of example in FIGS. 9, 11 and 17A-C, first sidewall 312 may comprise a plurality of protruded segments 316A disposed circumferentially along first sidewall 312 and protruding radially away from other portions of first sidewall 312. In some embodiments, first sidewall 312 may include a plurality of complementary segments 318A disposed circumferentially along first sidewall 312 and adjacent to a respective protruded segment 316A. In certain embodiments, protruded segments 316A and complementary segments 318A may alternate along the perimeter of first sidewall 312.

In some embodiments, as shown, for example, in FIG. 11, each complementary segment 318A may extend circumferentially along the periphery of first sidewall 312 at a fixed radius Rc and each protruded segment 316A may extend circumferentially along the periphery of first sidewall 312 at a variable radius Rp1-2 that is greater than the fixed radius Rc. That is, any point disposed along protruded segment 316A is located further away from longitudinal axis 301 of cap 300 than any point disposed along an adjacent complementary segment 318A. In some embodiments, as shown, for example, in FIG. 11, any point along complementary segment 318A is separated from the longitudinal axis 301 of cap 300 by the same distance (i.e., radius Rc), whereas any two points disposed along protruded segment 316A are separated from the longitudinal axis 301 of cap 300 by different distances (i.e., radius Rp1 and radius Rp2). In some embodiments, Rp1 is less than Rp2, which are both greater than Rc.

In certain embodiments, as shown, for example, in FIG. 11, a lateral cross-sectional profile of upper cap portion 310 (e.g., a contour of upper cap portion 310 taken along a plane extending orthogonal to longitudinal axis 301) may be asymmetrical. In some embodiments, first sidewall 312 may comprise three protruded segments 316A and three complementary segments 318A alternating circumferentially along the periphery of upper cap portion 310 to define an irregular-shaped polygonal (e.g., hexagonal) profile with curved faces. In some embodiments, first sidewall 312 may comprise any number of protruded segments 316A (e.g., one, two, three, four, or five) and any number of complementary segments 318A (e.g., one, two, three, four, or five) to define a polygonal lateral cross-sectional profile with curved faces.

In certain embodiments, as shown in FIGS. 9-11, for example, each protruded segment 316A may comprise a curved edge 317A protruding radially away from a portion (e.g., a respective complementary segment 318A) of first sidewall 312. In certain embodiments, each curved edge 317A may extend along first sidewall 312 in an axial direction and in a circumferential direction. In some embodiments, each curved edge 317A may comprise a semi-elliptical-shaped profile defining a major axis and a minor axis, in which the major axis is greater than the minor axis.

In some embodiments, each protruded segment 316A may comprise an edge protruding radially from a portion (e.g., a respective complementary segment 318A) of first sidewall 312 that forms other shapes, such as a slanted planar edge, a vertical planar edge, or a multiple-curved edge. For example, in one embodiment as shown in FIGS. 14A-D, upper cap portion 310 may include a protruded edge 317C comprising a semi-oval shaped profile. In some embodiments, protruded edge 317C extends from two locations along an edge of skirt 330 to define part of the boundary of two respective protruded segments 316C and the boundary of a complementary segment 318C disposed between the two respective protruded segments 316C.

In some embodiments, the shape of protruded segments and complementary segments may include rounded edges. For example, as shown in FIGS. 12A-E, first sidewall 312 may include a plurality of convex-shaped protruded segments 316B disposed circumferentially along first sidewall 312 that protrude radially away from other portions of first sidewall 312. In some embodiments, first sidewall 312 may include a plurality of concave-shaped complementary segments 318B disposed circumferentially along first sidewall 312 that recess radially toward longitudinal axis 301 of cap 300. In certain embodiments, protruded segments 316B and complementary segments 318B may alternate along the perimeter of first sidewall 312. In some embodiments, each protruded segment 316B may include a curved protruded edge 317B that tapers in width along an axial direction of cap 300.

In some embodiments, as shown in FIGS. 13A-D, 15A-D, and 16A-D, for example, first sidewall 312 may include a plurality of polygonal segments 319A-F disposed circumferentially along first sidewall 312 to define a polygonal-shaped lateral cross-section profile (e.g., shape of first sidewall 312 taken along a lateral cross-section). In some embodiments, first sidewall 312 may include any number of polygonal segments, for example, such as in a range between 3 and 11 polygonal segments extending entirely around the perimeter of top 314.

In some embodiments, first sidewall 312 may include a plurality of vertex portions 360A-F disposed circumferentially along first sidewall 312. In some embodiments, the plurality of polygonal segments 319A-F and the plurality of vertex portions 360A-F alternate along the perimeter of first sidewall 312, where each pair of adjacent polygonal segments 319A-F meet at a respective vertex portion 360A-F. In some embodiments, the plurality of vertex portions 360A-F extend radially beyond any portion of polygonal segments 319A-F.

Figure 13A:
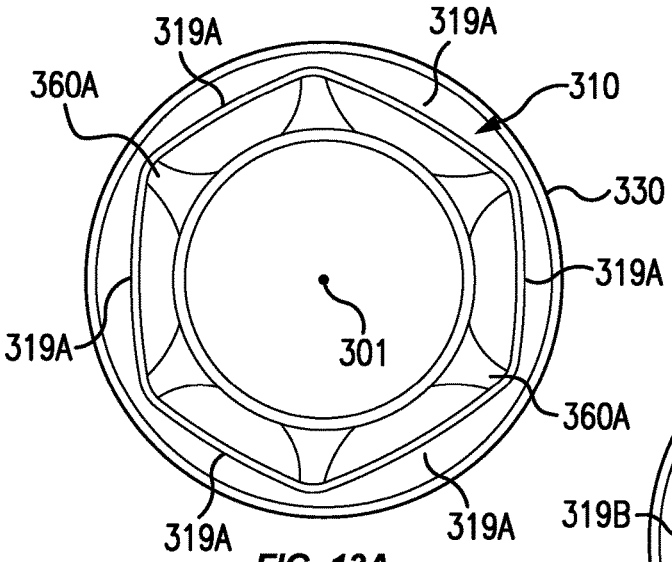
FIGS. 13A-D are each a top plan view of a cap, according to an embodiment.
Figure 13B:
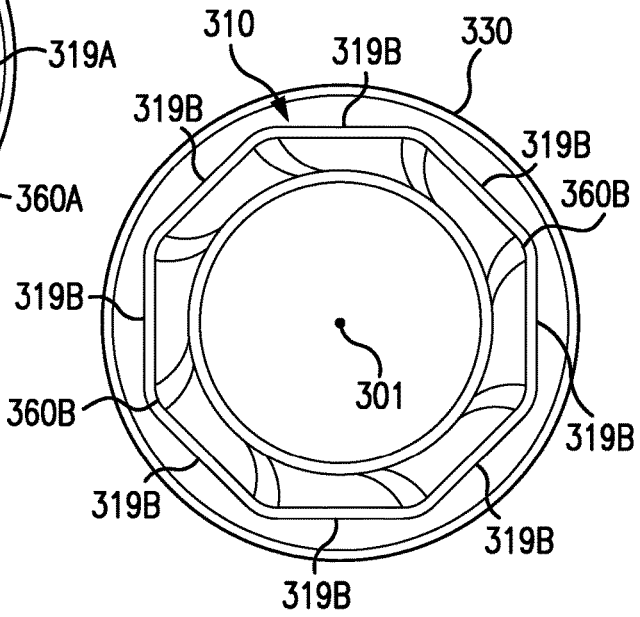
Figure 13C:
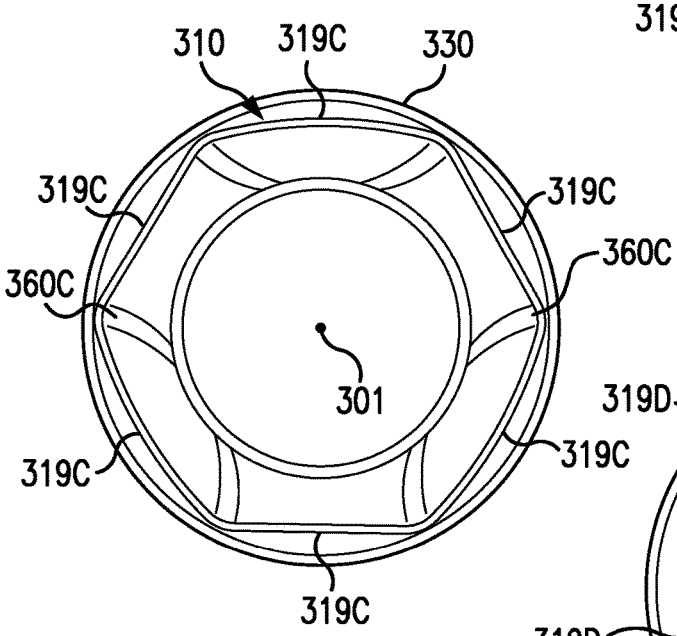
Figure 13D:
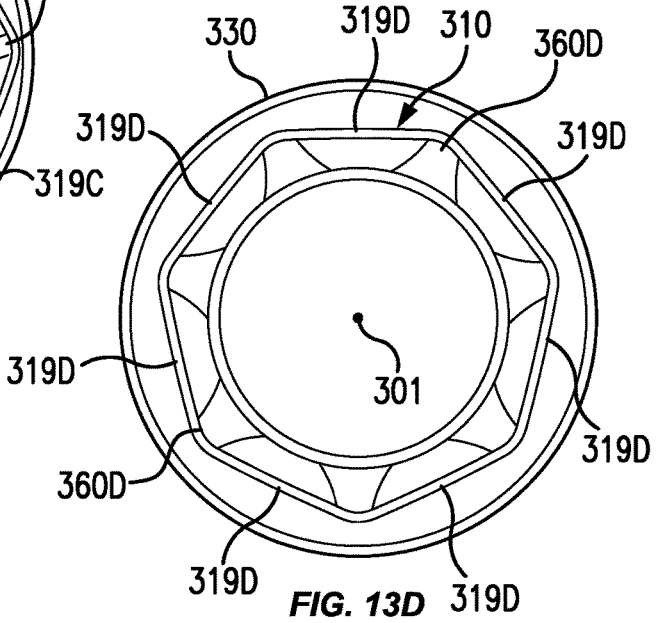
Figure 14A:
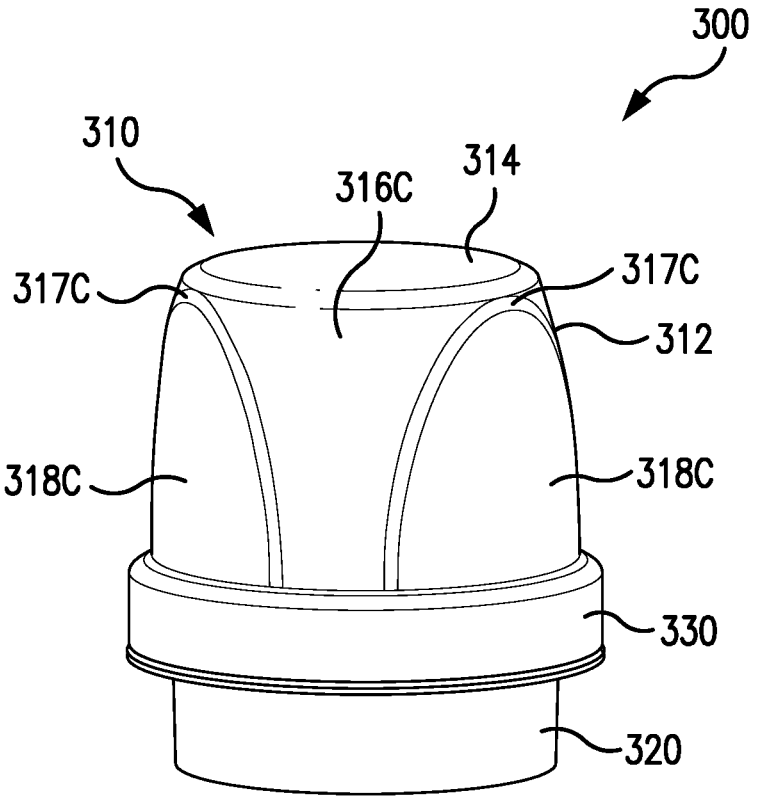
FIG. 14A is a front perspective view of a cap, according to an embodiment.
Figure 14B:
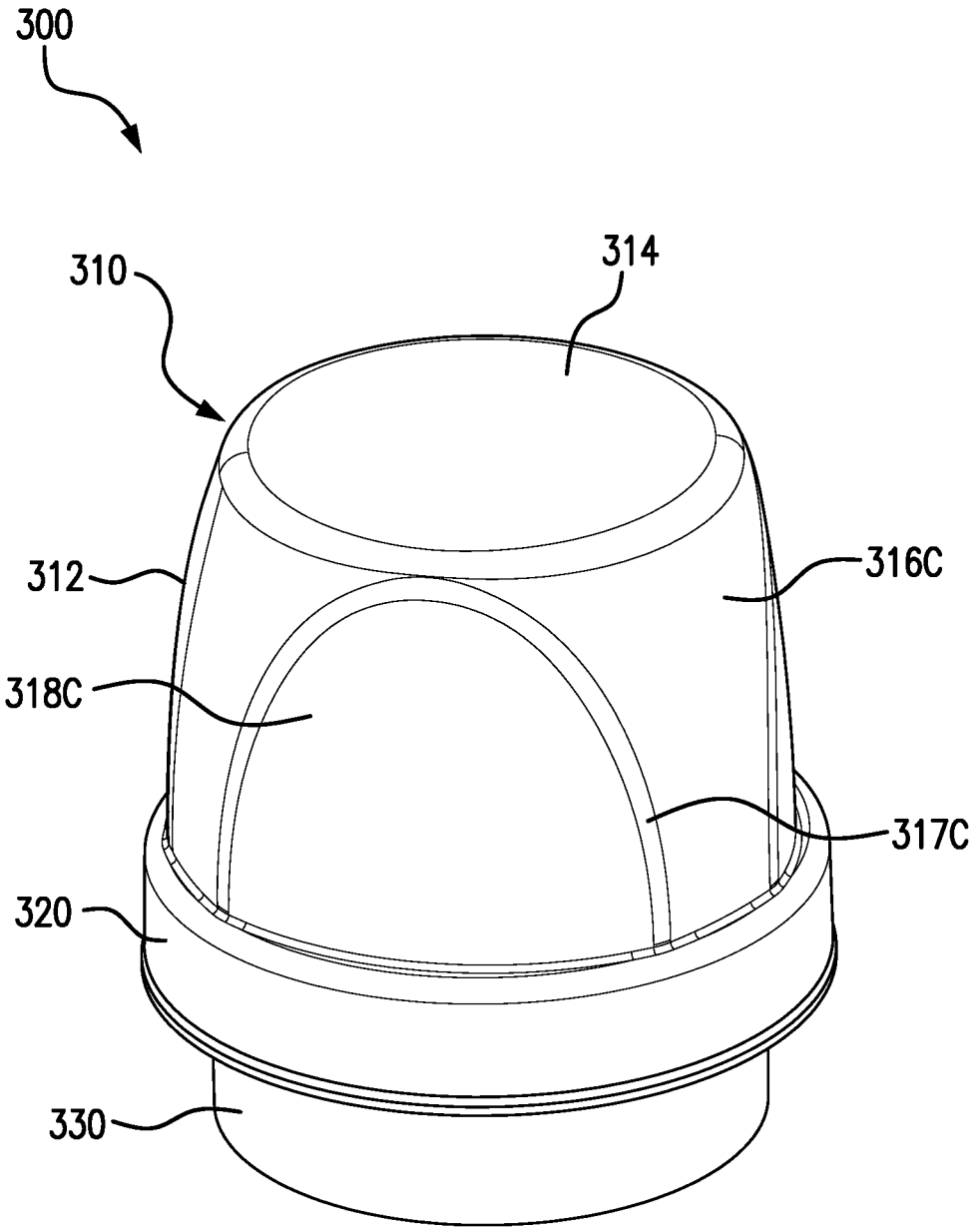
FIG. 14B is a top perspective view of a cap, according to an embodiment.
Figure 14C:
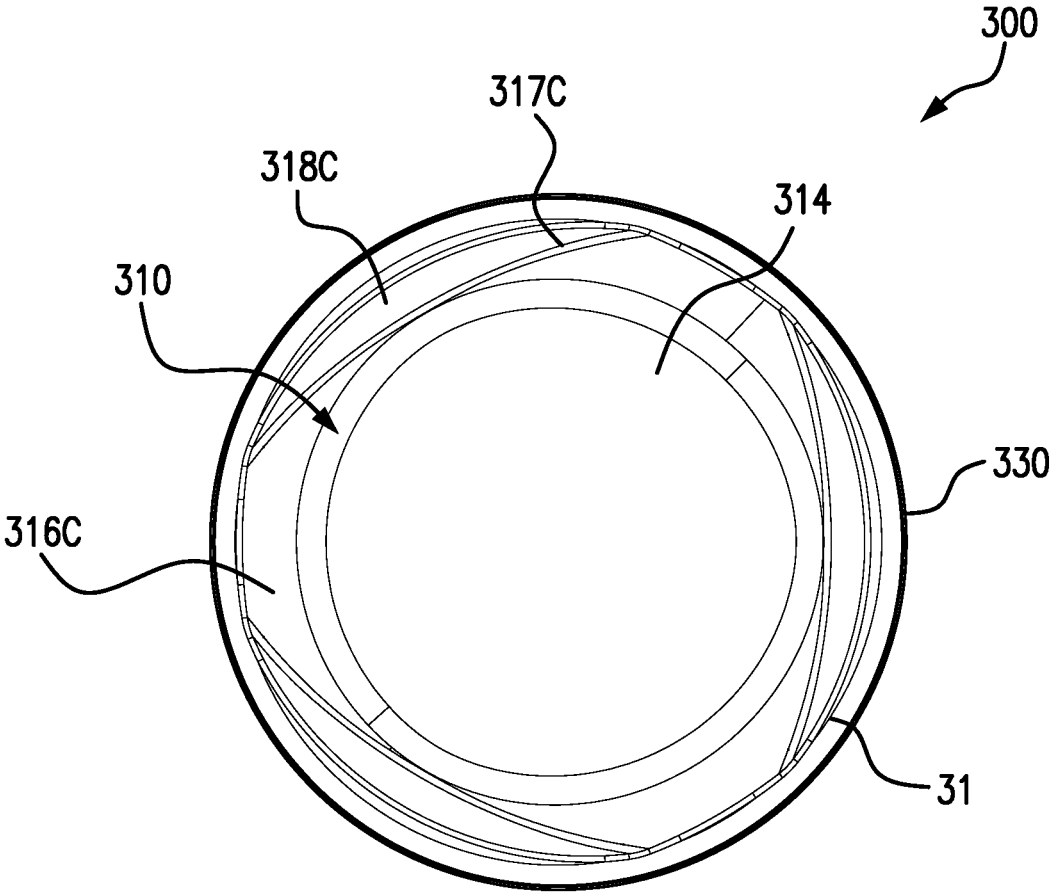
FIG. 14C is a plan view of a cap, according to an embodiment.
Figure 14D:
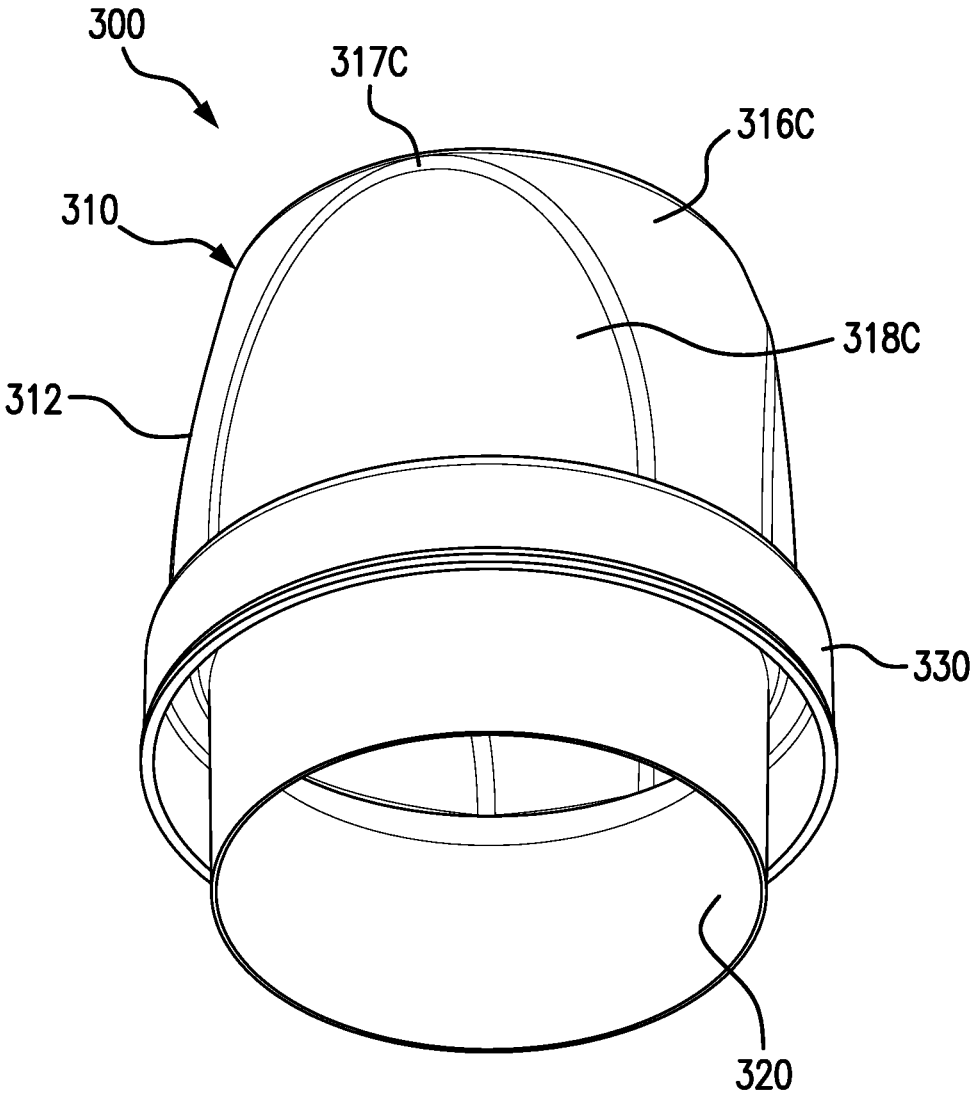
FIG. 14D is a bottom perspective view of a cap, according to an embodiment.
Figure 15A:
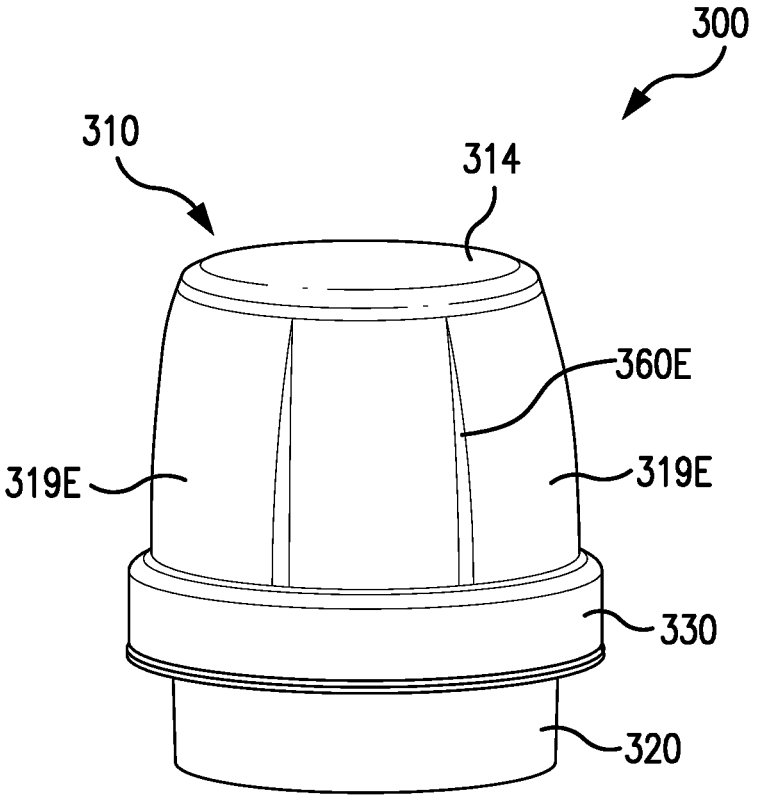
FIG. 15A is a front perspective view of a cap, according to an embodiment.
Figure 15B:
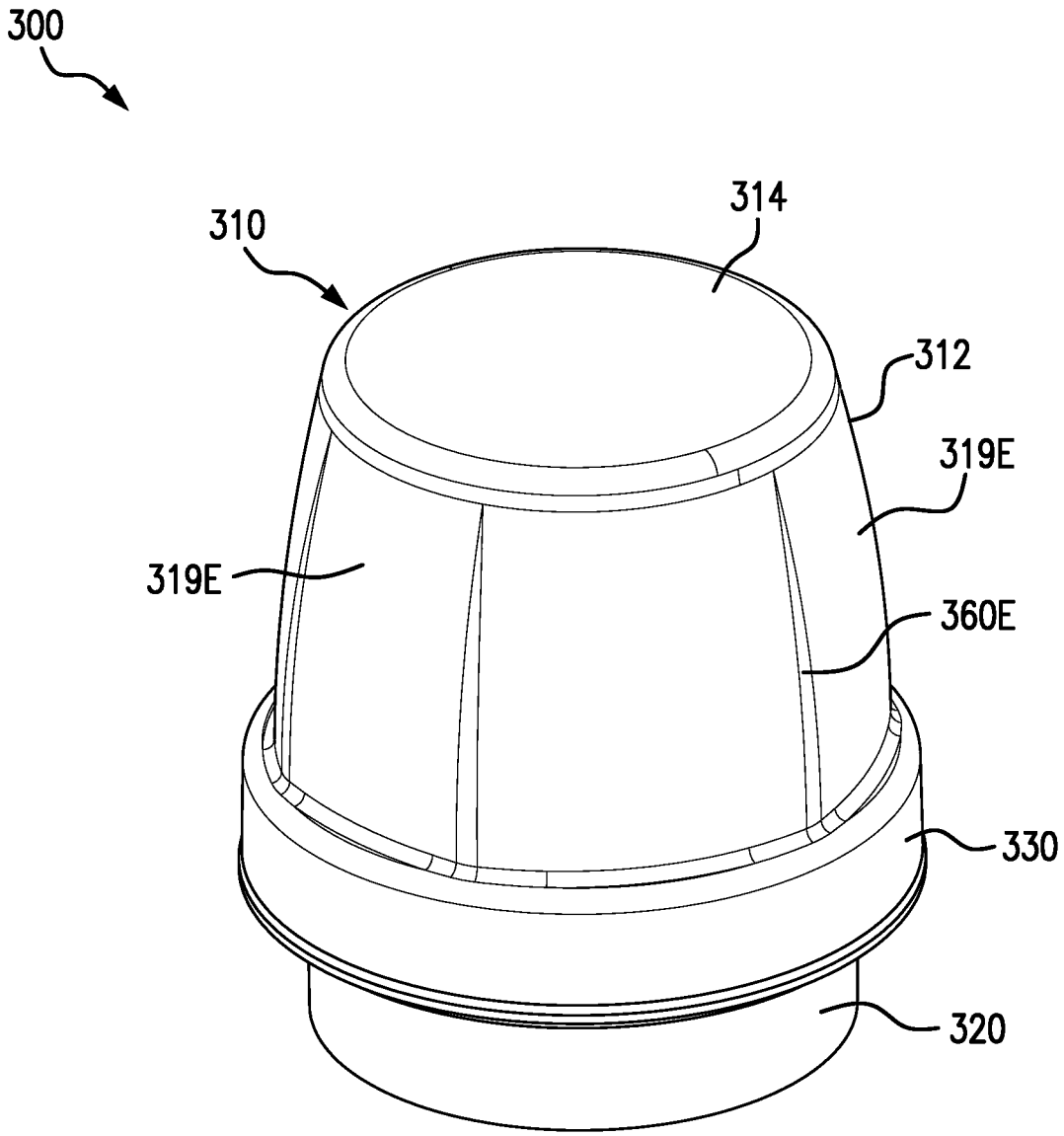
FIG. 15B is a top perspective view of a cap, according to an embodiment.
Figure 15C:
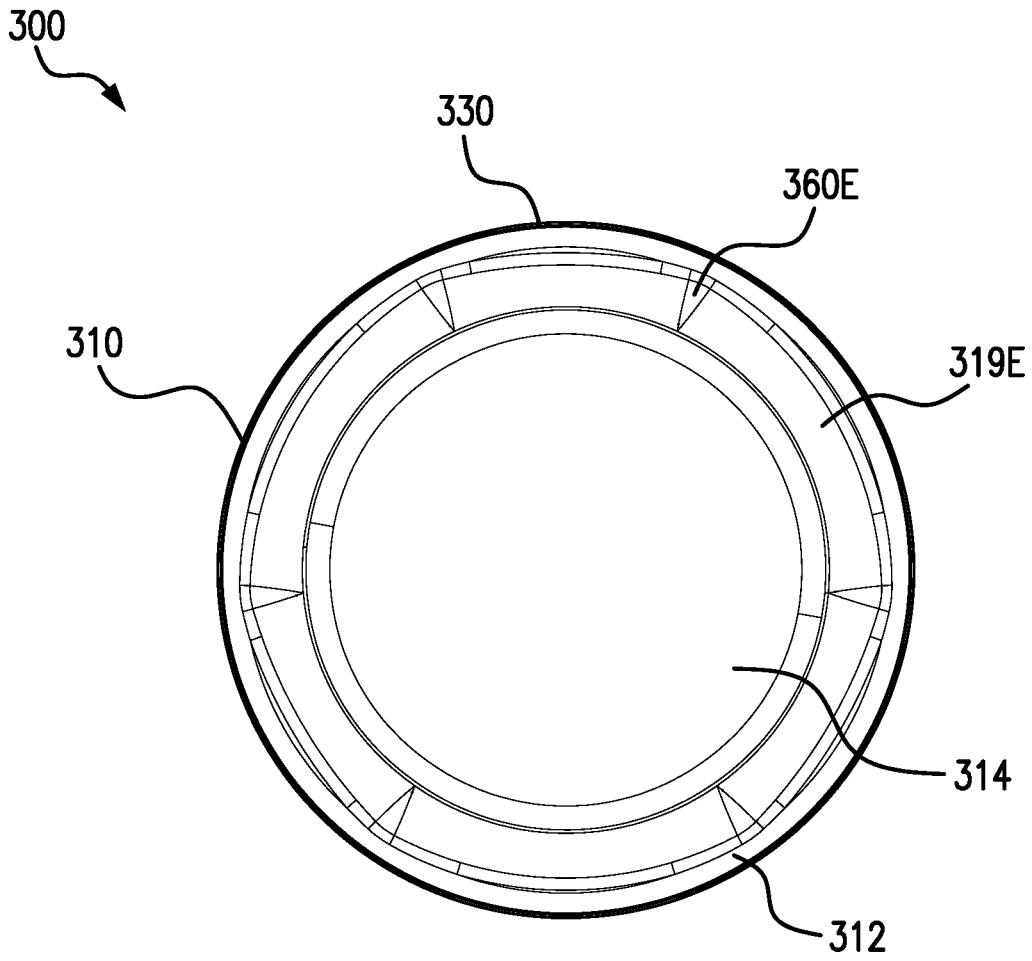
FIG. 15C is a plan view of a cap, according to an embodiment.
Figure 15D:
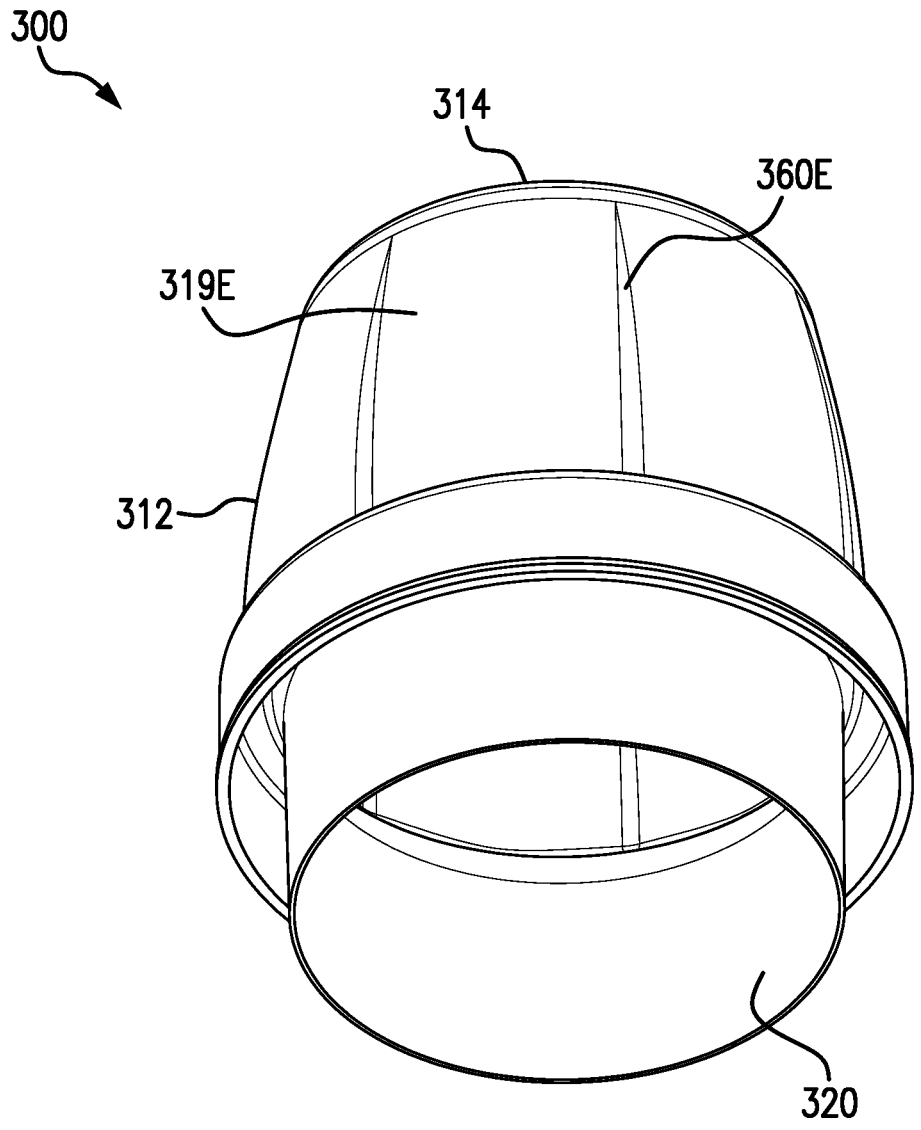
FIG. 15D is a bottom perspective view of a cap, according to an embodiment.
Figure 16A:
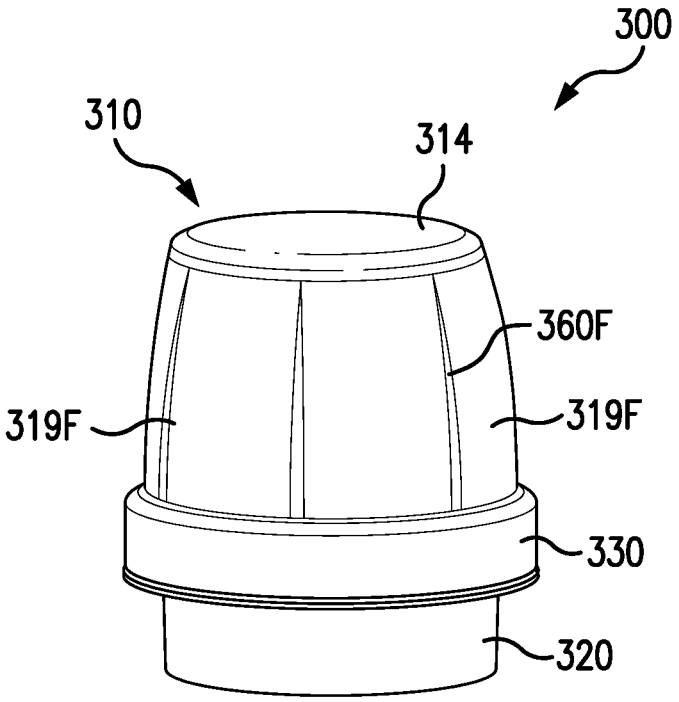
FIG. 16A is a front perspective view of a cap, according to an embodiment.
Figure 16B:
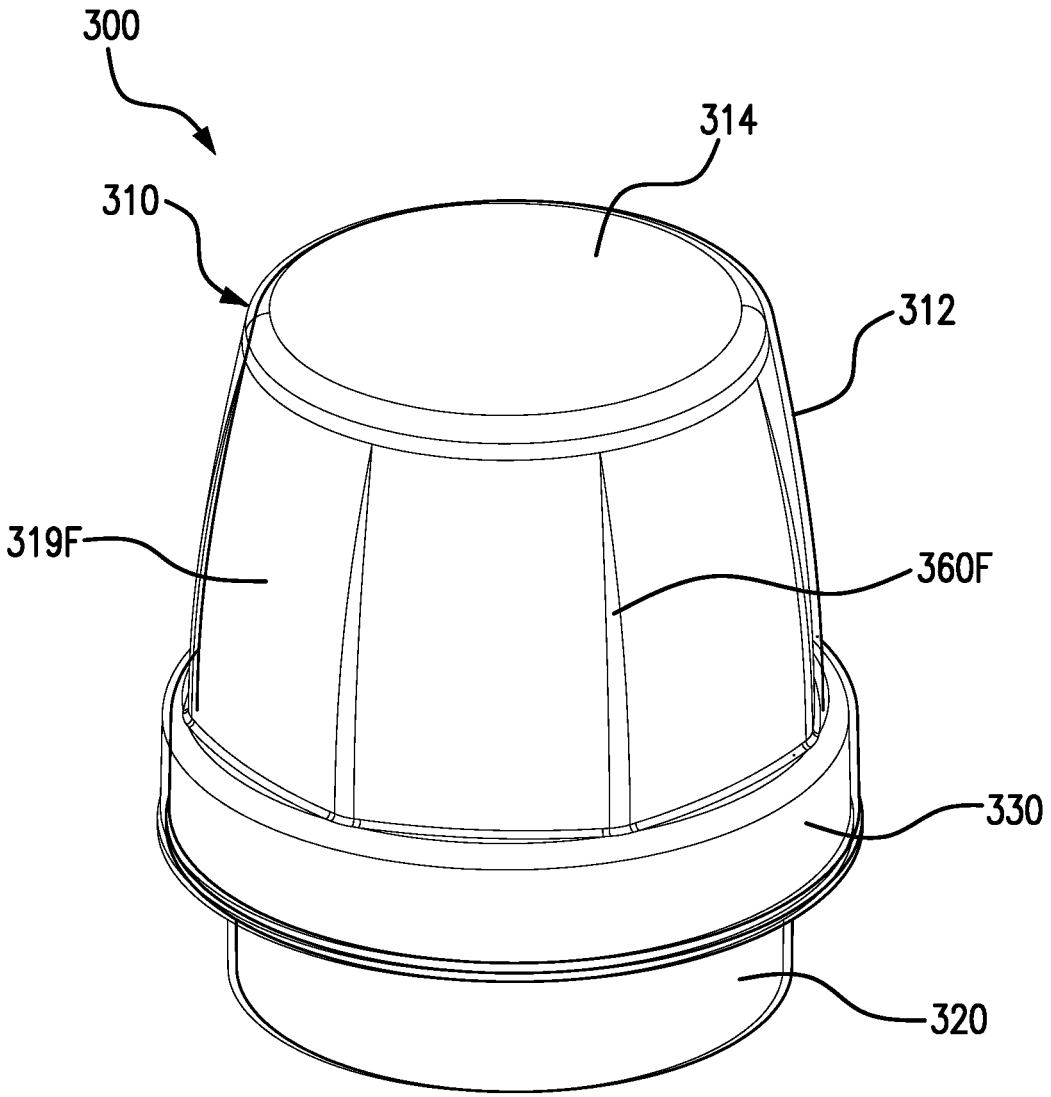
FIG. 16B is a top perspective view of a cap, according to an embodiment.
Figure 16C:
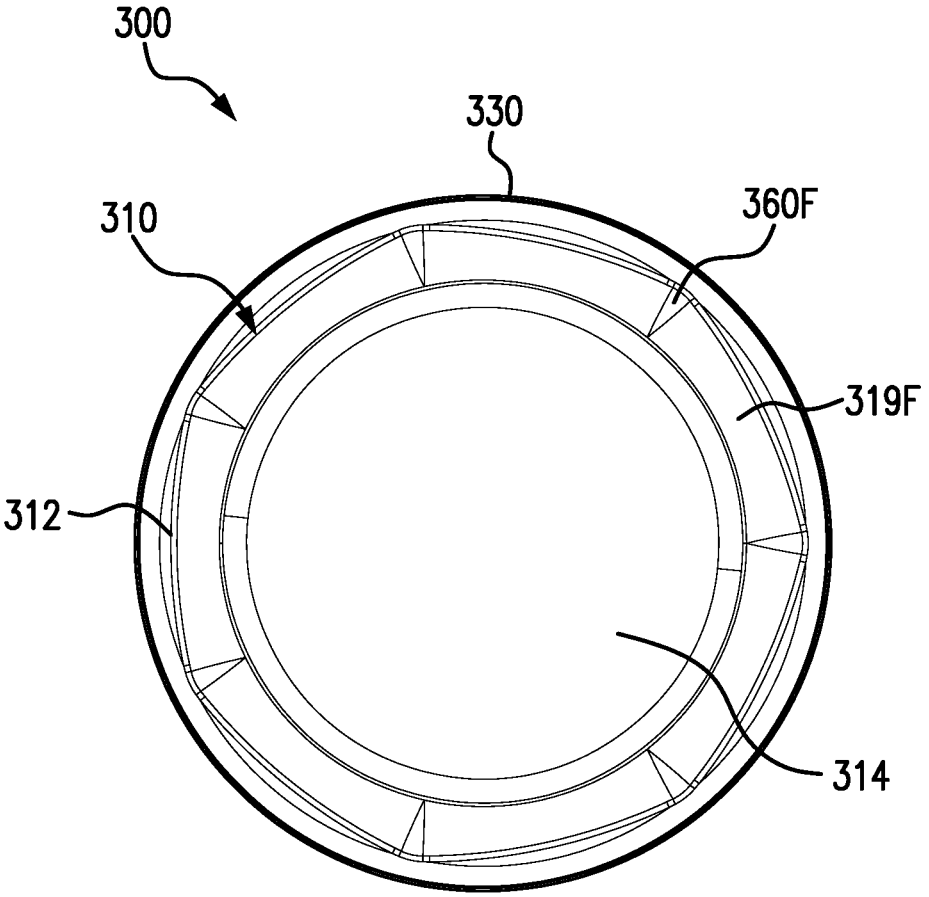
FIG. 16C is a plan view of a cap, according to an embodiment.
Figure 16D:
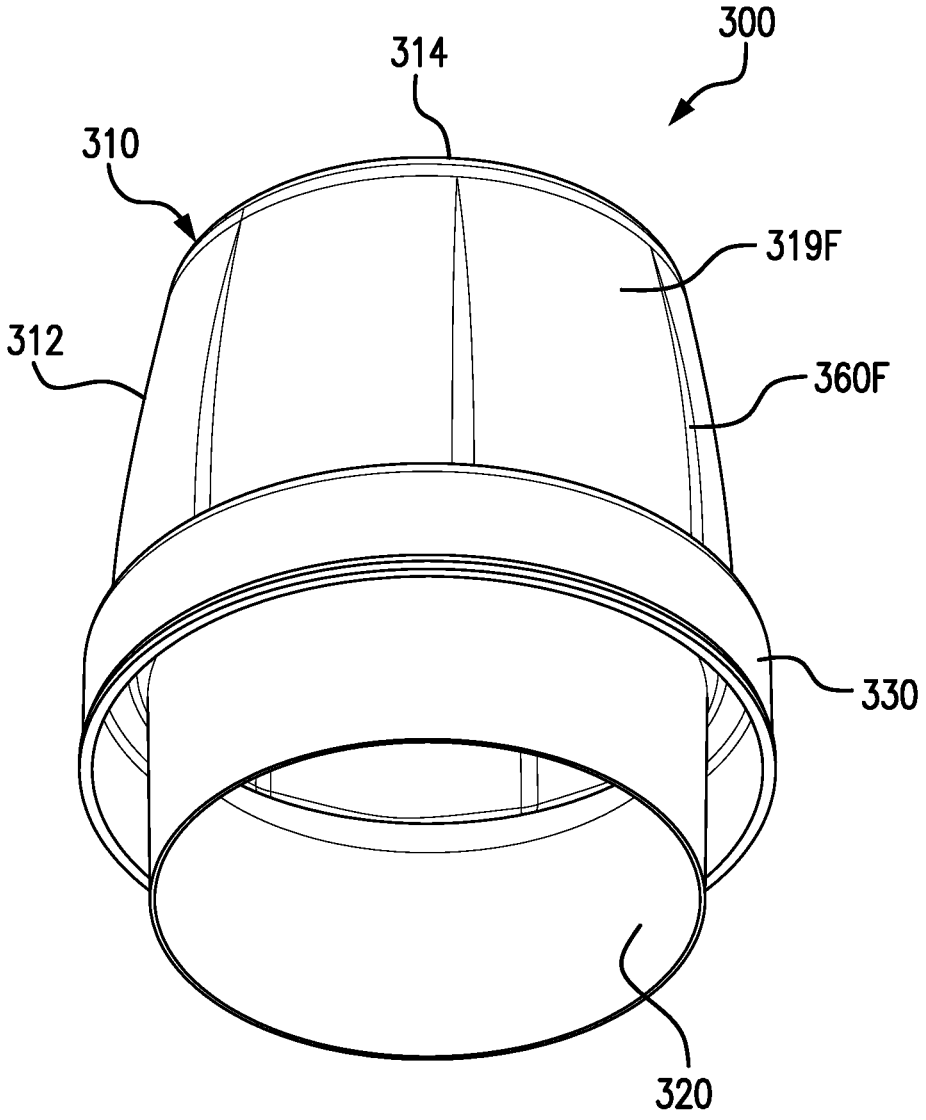
FIG. 16D is a bottom perspective view of a cap, according to an embodiment.
Figure 17A:
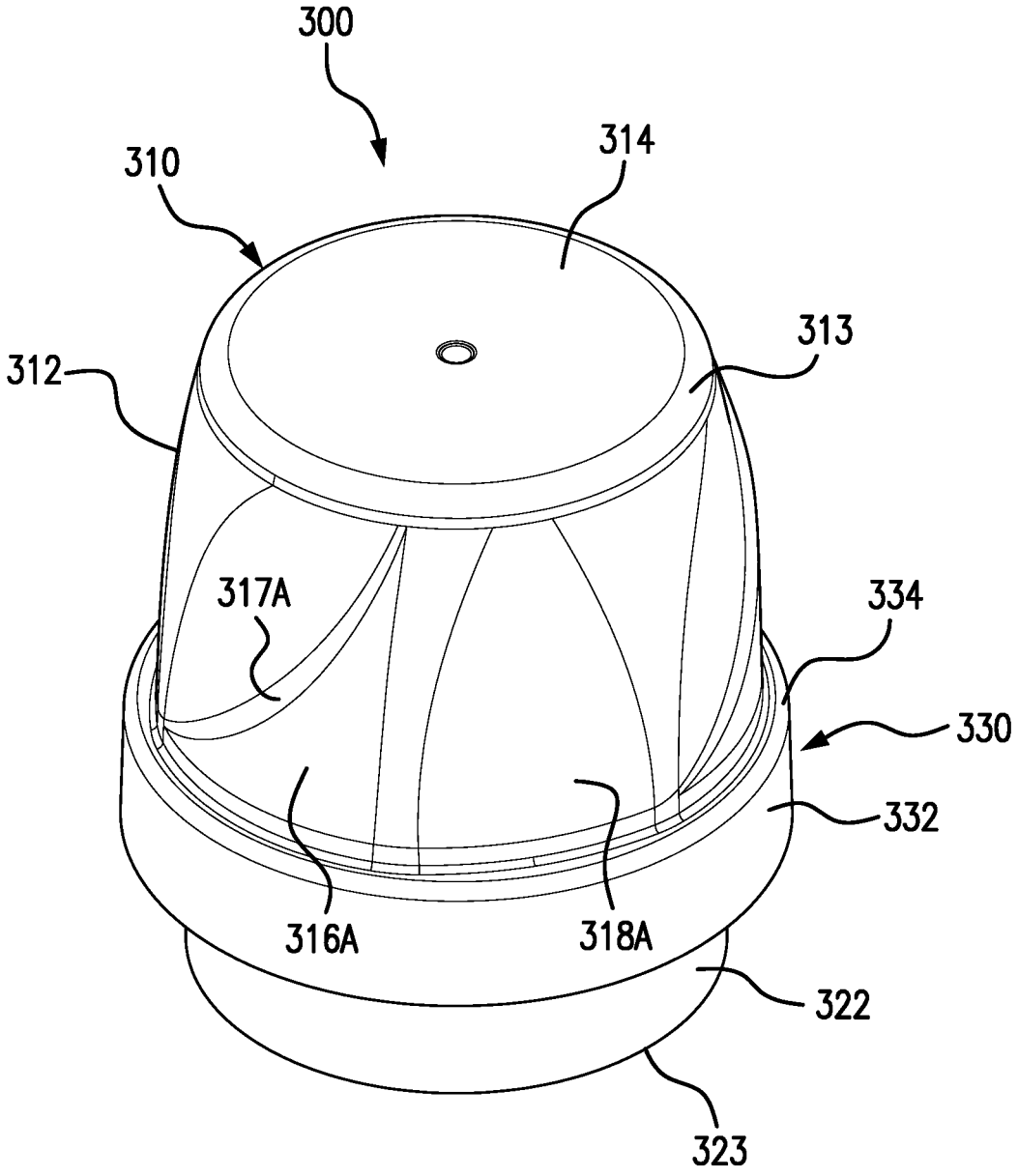
FIG. 17A is a top perspective view of a cap, according to an embodiment.
Figure 17B:
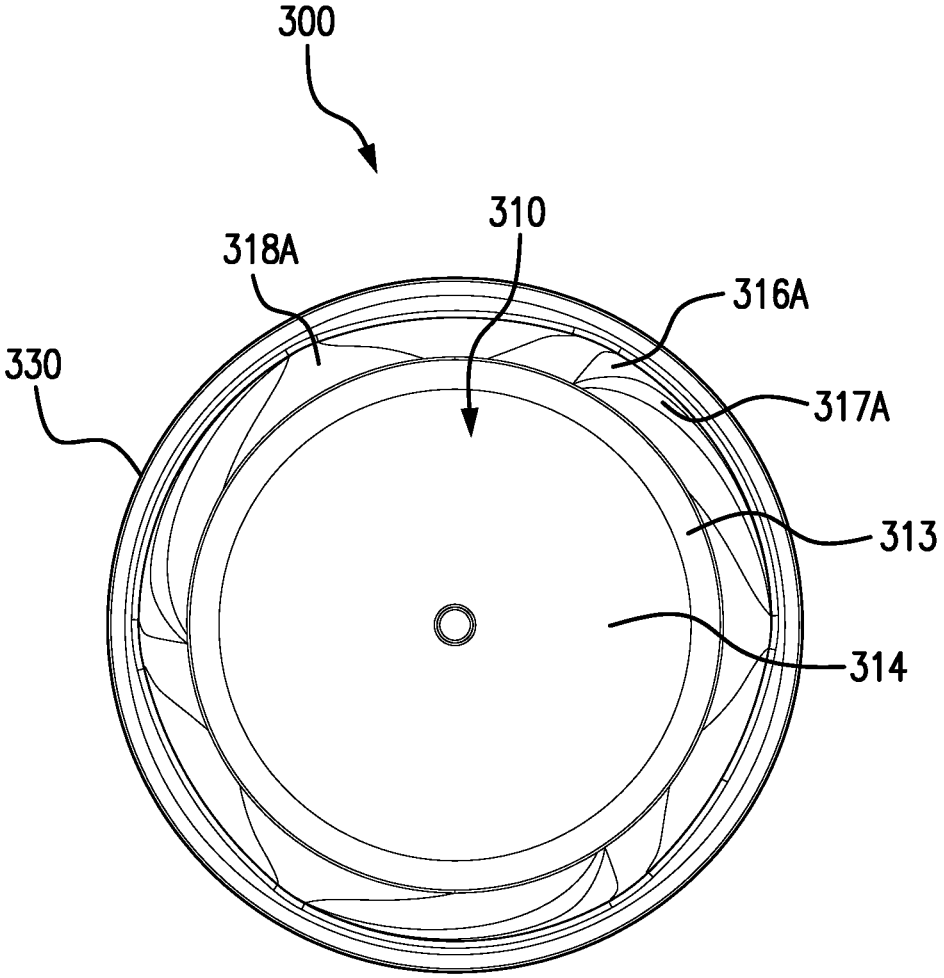
FIG. 17B is a plan view of a cap, according to an embodiment.
Figure 17C:
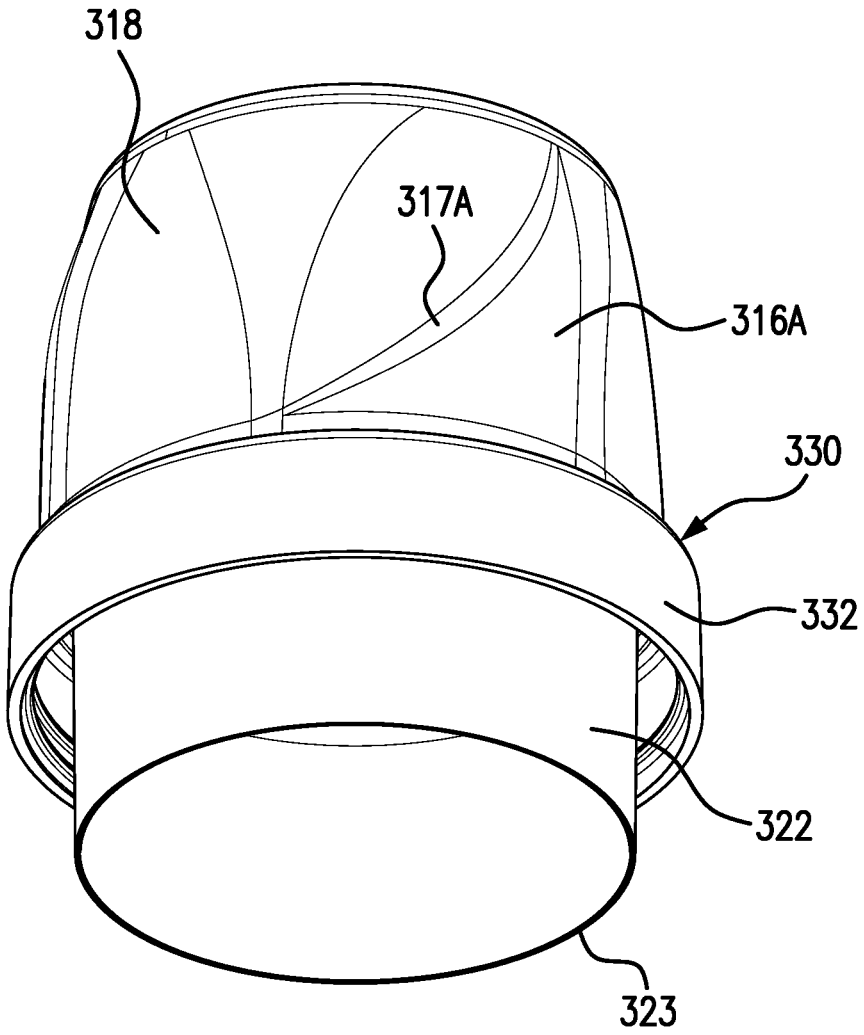
FIG. 17C is a bottom perspective view of a cap, according to an embodiment.

In some embodiments, the plurality of polygonal segments 319A-F may be straight or curved. In one example, as shown in FIGS. 13A and 13B, upper cap portion 310 may include a polygonal-shaped lateral profile (e.g., heptagonal in FIG. 13A and octagonal in FIG. 13B) with straight-shaped segments 319A and 319B disposed circumferentially along first sidewall 312. In some embodiments, as shown in FIGS. 13C, 13D, 15A-D, and 16A-D, upper cap portion 310 may include a polygonal-shaped lateral cross-section profile (e.g., hexagonal in FIGS. 13C, 15A-D and heptagonal in FIGS. 13D, 16A-D) with curved-shaped segments 319C-F disposed circumferentially along first sidewall 312. In some embodiments, as shown in FIGS. 13C and 13D, the transverse dimension of upper cap portion 310 and length of segments 319C and 319D may be varied to adjust the dosage capacity of upper cap portion 310.

Referring to FIG. 10, for example, in certain embodiments, skirt 330 may comprise a flange 334 extending radially with respect to the longitudinal axis 301 of cap 300. In some embodiments, flange 334 may extend from the upper cap portion 310 and/or lower cap portion 320. In certain embodiments, flange 334 may extend radially from upper cap portion 310 and lower cap portion 320 at intersection 342 disposed along the transition region 340. In some embodiments, flange 334 may extend radially from any point disposed along rim wall 341 of transition region 340, first sidewall 312 of upper cap portion 310, or second sidewall 322 of lower cap portion 320. In certain embodiments, skirt 330 may comprise a third sidewall (e.g. skirt sidewall 332) extending from flange 334. In some embodiments, skirt sidewall 332 may extend around first sidewall 312 and/or second sidewall 322. In some embodiments, skirt sidewall 332 may be disposed concentrically with respect to first sidewall 312 and/or second sidewall 322.

In some embodiments, skirt 330 may comprise one or more fastener structures to secure cap 300 to neck 110 of bottle 100. In certain, embodiments, the one or more fastener structures may be arranged in helical formation along the inner surface of skirt sidewall 332 such that the one or more fastener structures may interface with thread 130 of neck 110. For example, in certain embodiments, as shown in FIG. 10, skirt 330 may comprise a rib 336 disposed circumferentially along an inner surface 333 of skirt sidewall 332. In certain embodiments, rib 336 may be configured to slidingly engage thread 130 of neck 110, so that cap 300 may be torqued around neck 110, thereby securing cap 300 to bottle 100. In some embodiments, rib 336 may wind helically along inner surface of skirt sidewall 332 from a first end to a second end, in which second end is disposed below first end in an axial direction. In some embodiments, rib 336 may extend along the inner surface of skirt sidewall 332 in other formations, such as a ring formation.

In some embodiments, cap 300 may include upper cap portion 310 configured to enclose opening 120 of neck 110 and skirt 330 configured to secure cap 300 to bottle 100, without including lower cap portion 320. In some embodiments, cap 300 may include only upper cap portion 310, without including lower cap portion 320 and skirt 330, in which the first sidewall 312 of upper cap portion 310 may include one or more fastener structures (e.g., rib 336) to secure cap 300 to neck 110 of bottle 100.

In some embodiments, the transverse dimensions of upper cap portion 310, lower cap portion 320, and skirt 330 may be configured to increase the dosage capacity of cap 300, while still allowing cap 300 to be intimately secured against neck 110 of bottle 100.

As shown, for example, in FIG. 10, in certain embodiments, upper cap portion 310 may comprise a transverse dimension A (e.g., internal diameter of first sidewall 312) defined at the lower end of first sidewall 312 proximate to intersection 342. In certain embodiments, transverse dimension A may range from about 25 mm to about 125 mm, such as from about 50 mm to about 75 mm. In certain embodiments, upper cap portion 310 may comprise a transverse dimension D (e.g., diameter of top 314) defined at the top 314. In certain embodiments, transverse dimension D may be less than transverse dimension A and may range from about 20 mm to about 120 mm, such as from about 50 mm to about 75 mm. In some embodiments, as shown in FIG. 10, a longitudinal cross-sectional profile of upper cap portion 310 (e.g., a contour of upper cap portion 310 taken along a plane extending parallel with longitudinal axis 301) may be arch-shaped such that an intersection between top 314 and first sidewall 312 comprises a rounded edge 313 and first sidewall 312 curves radially outward with respect to longitudinal axis 301. The arch-shaped longitudinal profile of upper cap portion 310 allows cap 300 to effectively deflect impact forces applied against the cap 300 such that cap 300 may withstand greater drop impact without being damaged.

In certain embodiments, lower cap portion 320 may comprise a transverse dimension B (e.g., internal diameter of second sidewall 322), defined at a point along the second sidewall 322, that is less than transverse dimension A. In certain embodiments, transverse dimension B may be greater than transverse dimension D. In certain embodiments, transverse dimension B ranges from about 25 mm to about 125 mm, such as from about 50 mm to about 75 mm. In certain embodiments, transverse dimension B may be about 57 mm. In some embodiments, lower cap portion 320 may comprise a fixed transverse dimension such that the transverse dimension (e.g., transverse dimension B) of lower cap portion 320 remains constant at any point along second sidewall 322.

In certain embodiments, rim wall 341 of transition region 340 curves toward longitudinal axis 301 of cap. In certain embodiments, a transverse dimension of transition region 340 (e.g., internal diameter of rim wall) tapers from transverse dimension A to transverse dimension B. In certain embodiments, skirt 330 may comprise a transverse dimension C (e.g., internal diameter of skirt sidewall 332), defined at a point along skirt sidewall 332, that is greater than the first transverse dimension A. In certain embodiments, the transverse dimension C may range from about 25 mm to about 130 mm, such as from about 55 mm to about 80 mm. In certain embodiments, transverse dimension C may be about 50 mm. In certain embodiments, transverse dimension C may be about 72 mm.

In certain embodiments, the longitudinal and transverse dimensions of upper cap portion 310 may define a first volume that forms a first section of chamber 350. In certain embodiments, the longitudinal and transverse dimensions of lower cap portion 320 may define a second volume that forms a second section of chamber 350. In some embodiments, the first volume defined by upper cap portion 310 may be greater than the second volume provided by lower cap portion 320. In other embodiments upper cap portion 310 may be smaller than lower cap portion 320.

Referring back to FIG. 3, which shows a partial cross-section view of bottle assembly 10, spout 200 is disposed in neck 110 and cap 300 is secured to bottle 100. In some embodiments, when cap 300 is secured to bottle 100, the interior surface of skirt 330 engages exterior surface 114 of neck 110 and/or seal ring 250. As shown in FIG. 3, for example, flange 334 of skirt 330 abuts seal ring 250 against rim 111 of neck 110 to promote a fluid-tight seal between cap 300 and neck 110, preventing liquid from escaping bottle assembly 10. In some embodiments, rib 336 of skirt sidewall 332 interfaces with thread 130 of neck 110 to promote connection between cap 300 and neck 110. In some embodiments, when cap 300 is secured to bottle 100, second sidewall 322 of lower cap portion 320 extends into neck 110 and is received between central duct 230 and outer sidewall 210 of spout 200.

In some embodiments, when cap 300 is secured to bottle 100, upper cap portion 310 encloses opening 120 such that the pouring passage 240 of central duct 230 opens into chamber 350 of cap 300. In some embodiments, as shown in FIG. 3, for example, when cap 300 is secured to bottle 100, intersection 342 is substantially aligned with rim 111 of neck 110. In some embodiments, at least a portion of first sidewall 312 (e.g., lower end of first sidewall 312) is aligned with neck 110, which allows cap 300 to withstand greater impact by transferring impact forces down into neck 110 and improves the top load strength of cap 300 and the overall assembly. In some embodiments, the lower end of first sidewall 312 comprises a transverse dimension (e.g., transverse dimension A shown in FIG. 7) that corresponds to the transverse dimension of rim 111 of neck 110.

Figure 18:
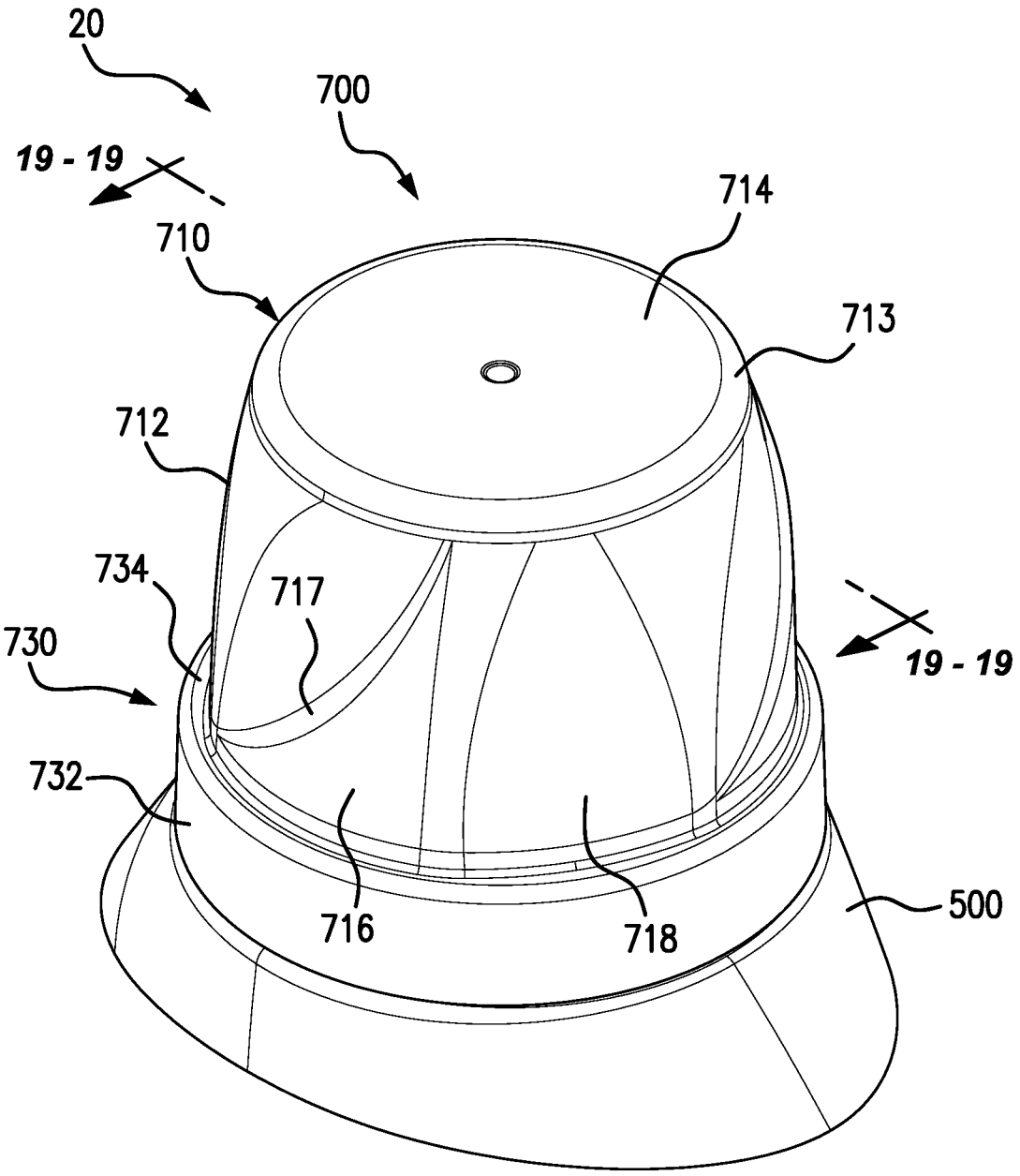
FIG. 18 is a perspective view of a bottle assembly with a cap fastened to the bottle, according to an embodiment.
Figure 19:
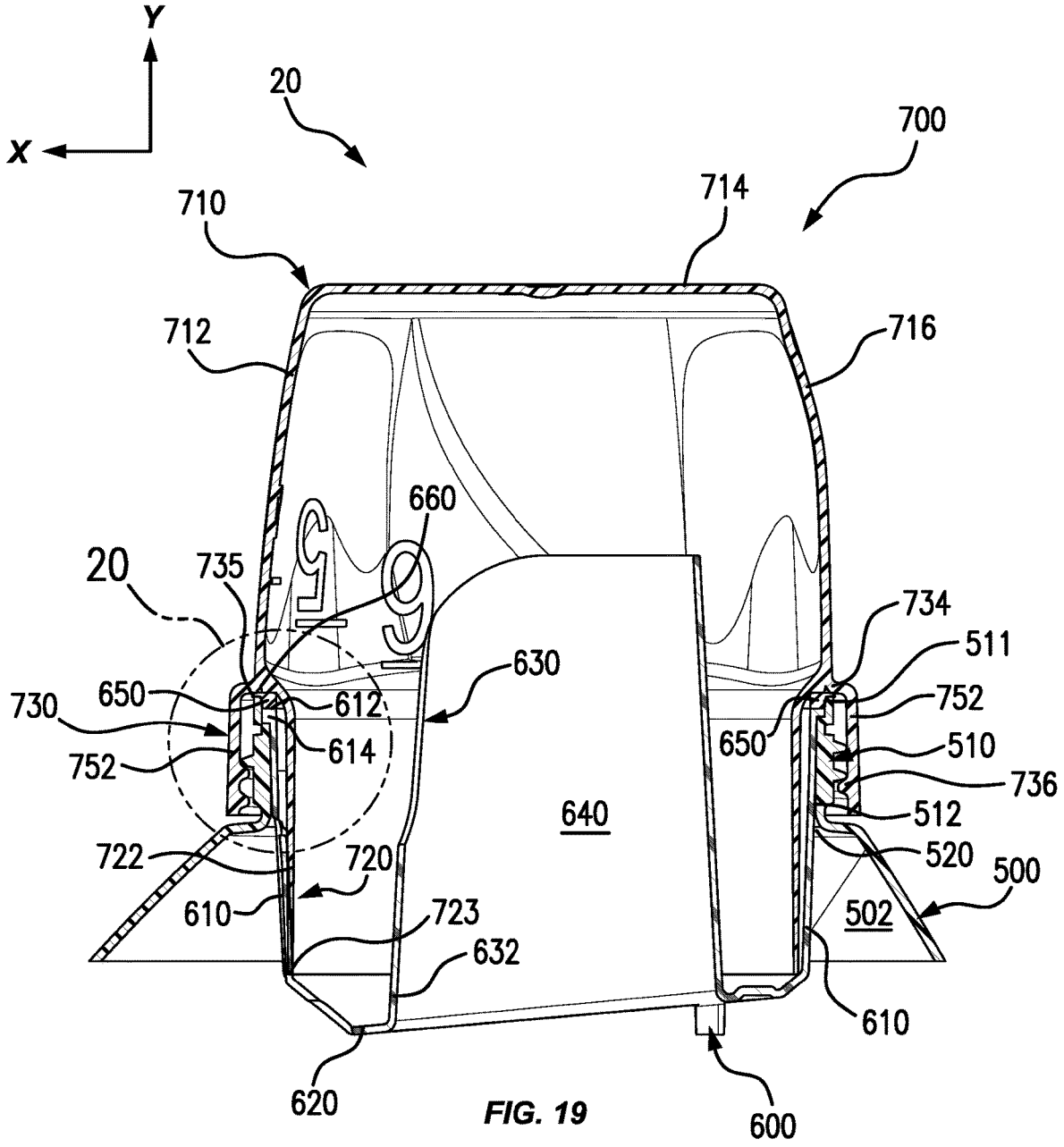
FIG. 19 is a side cross sectional view of a bottle assembly with a cap secured to a neck of a bottle taken along line 19-19 of FIG. 18, according to an embodiment.
Figure 20:
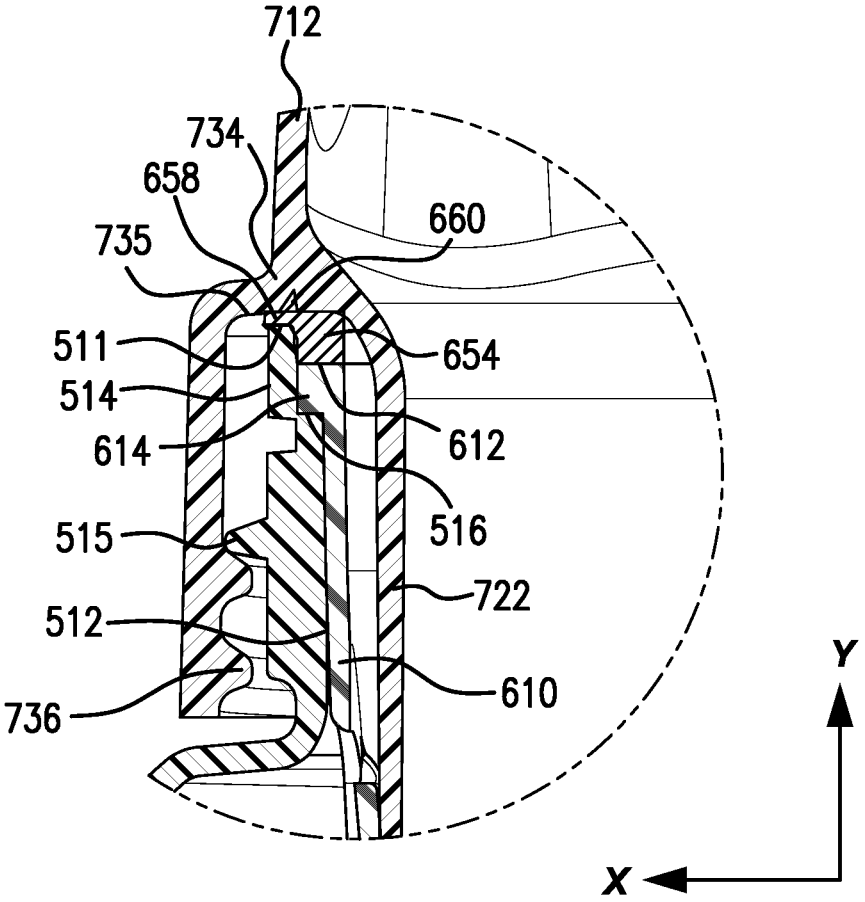
FIG. 20 is an enlarged partial cross-sectional view of the bottle assembly taken along broken line 20 of FIG. 19, according to an embodiment.

FIGS. 18-20 illustrate a bottle assembly 20 according to some embodiments. Bottle assembly 20 may include a bottle 500, a spout 600 with a seal ring 650, and a cap 700 that are similar to or the same as other embodiments described herein (e.g., bottle assembly 10 including bottle 100, spout 200, seal ring 250, and cap 300). For example, bottle 500 may define a reservoir 502 for storing a fluid therein and may comprise a neck 510 defining an opening into reservoir 502. In some embodiments, spout 600 may be disposed in neck 510 of bottle 500 and may be configured to direct fluid received from reservoir 502 through opening 520 without allowing dispensed fluid to accumulate around neck 510. In certain embodiments, cap 700 may be removably coupled to neck 510 of bottle 500 to seal fluid stored in reservoir 502 of bottle 500 and be removed from neck 510 of bottle 500 to receive a dosage of fluid poured out of reservoir 502 of bottle 500.

Figure 23:
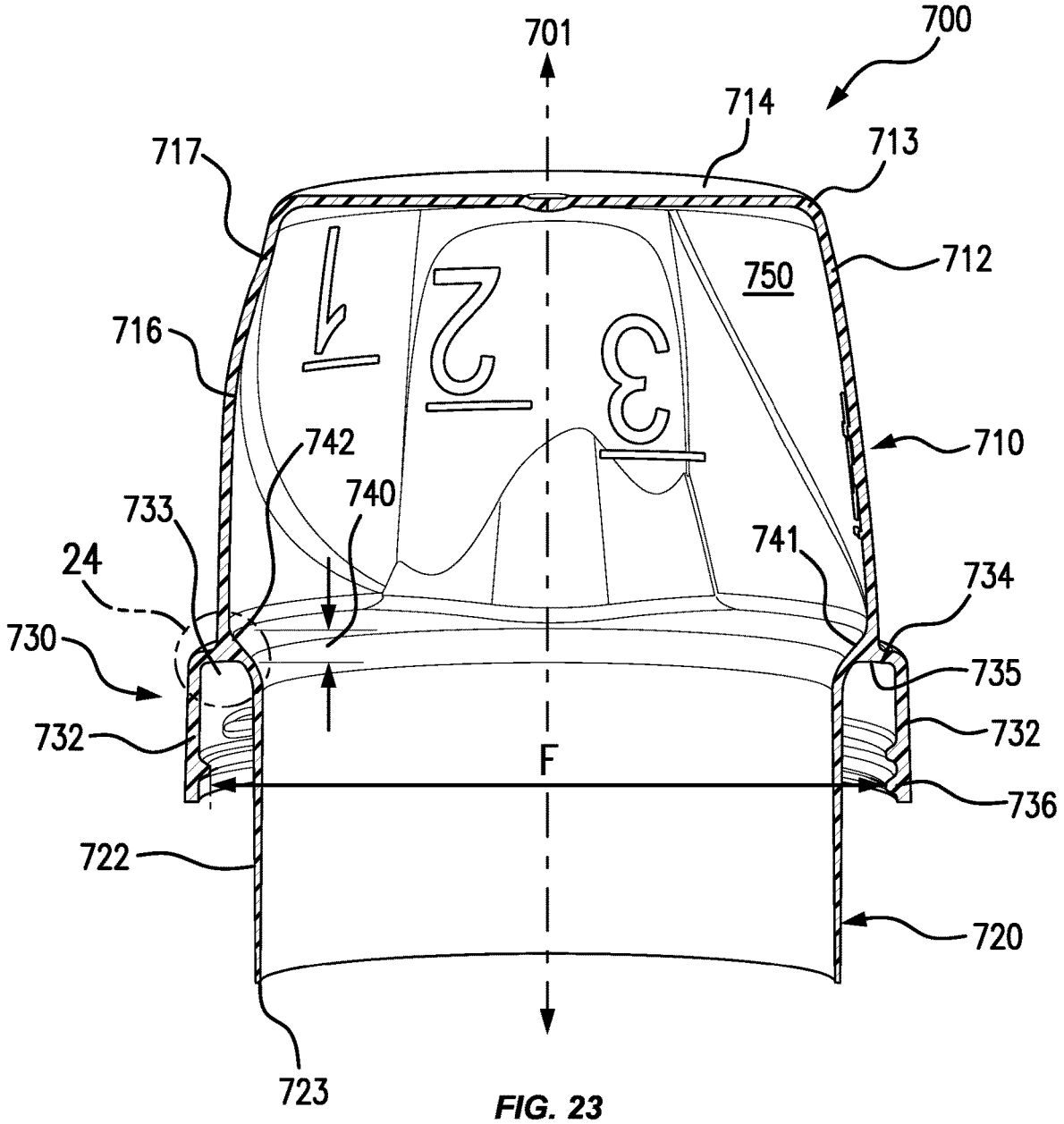
FIG. 23 is a side cross-sectional view of a cap shown in FIG. 18 taken along a central longitudinal axis of the cap, according to an embodiment.

Referring to FIGS. 19 and 23, in some embodiments, cap 700 may comprise an upper cap portion 710, a lower cap portion 720, and a skirt 730 that are similar to or the same as other embodiments described herein (e.g., upper cap portion 310, lower cap portion 320 and skirt 330 shown in FIGS. 9-11). For example, in some embodiments, upper cap portion 710 and lower cap portion 720 may be connected at an intersection 742 of a transition region 740 of cap 700 to define a chamber 750 extending along a longitudinal axis 701 of cap 700, and skirt 730 may extending radially from transition region 740 to engage neck 510 of bottle 500.

In some embodiments, upper cap portion 710 may include a top 714 and a first sidewall 712 extending around a perimeter of top 714 to transition region 740. In some embodiments, first sidewall 712 may include a plurality of protruded segments 716 with a curved edge 717 and complementary segments 718 disposed circumferentially along first sidewall 712, similar to or the same as other embodiments described herein (e.g., protruded segments 316A and complementary segments 318A shown in FIGS. 9-11).

In some embodiments, lower cap portion 720 may include a second sidewall 722 and a distal end 723 defining an opening into chamber 750, similar to or same as other embodiments described herein (e.g., second sidewall 322). In some embodiments, as shown in FIG. 23, transition region 740 may comprise a rim wall 741 extending from intersection 742 to an upper end of second sidewall 722. In some embodiments, upper cap portion 710 and lower cap portion 720 may include similar or the same dimensions as other embodiments described herein (e.g., relative dimensions of upper cap portion 310 and lower cap portion 320).

In some embodiments, skirt 730 may include a flange 734 extending radially from upper cap portion 710 and lower cap portion 720 at intersection 742 disposed along the transition region 740. In some embodiments, skirt 730 may include a third sidewall (e.g., skirt sidewall 732) extending from flange 734. In some embodiments, skirt sidewall 732 may extend around first sidewall 712 and/or second sidewall 722. In some embodiments, skirt sidewall 732 may be disposed concentrically with respect to first sidewall 712 and/or second sidewall 722. In some embodiments, skirt 730 may include a rib 736 disposed circumferentially along an inner surface 733 of skirt sidewall 732 to slidingly engage thread 515 of neck 510, so that cap 700 may be torqued around neck 510, thereby securing cap 700 to bottle 500.

Figure 26:
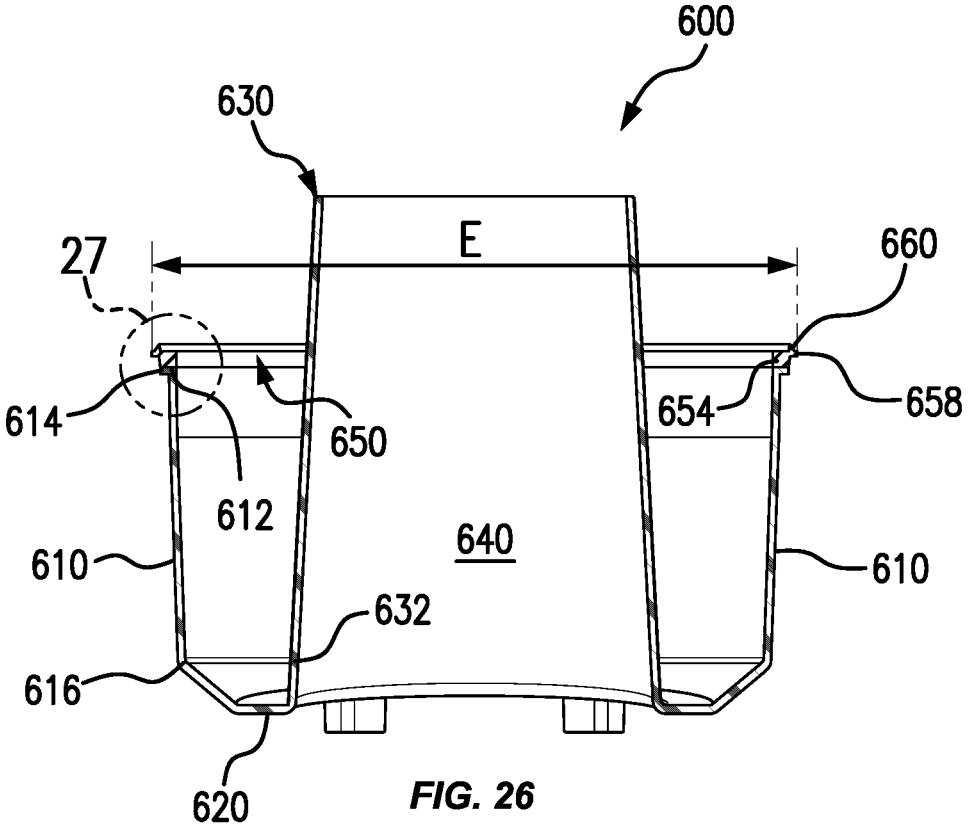
FIG. 26 is a side cross-sectional view of the spout taken along line 26-26 of FIG. 25, according to an embodiment.
Figure 27:
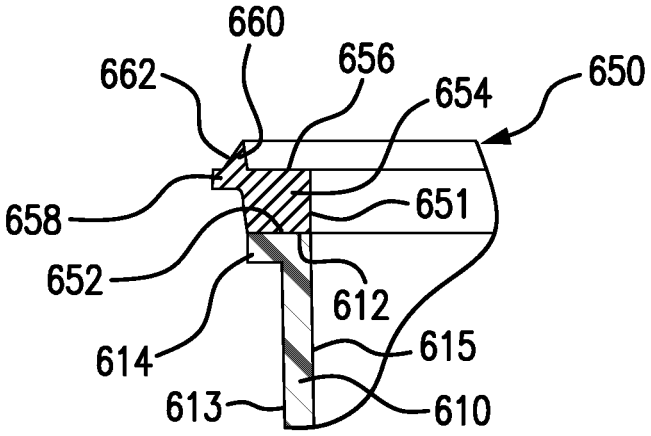
FIG. 27 is an enlarged partial cross-sectional view of a spout taken along broken line 27 of FIG. 26, according to an embodiment.
Figure 28:
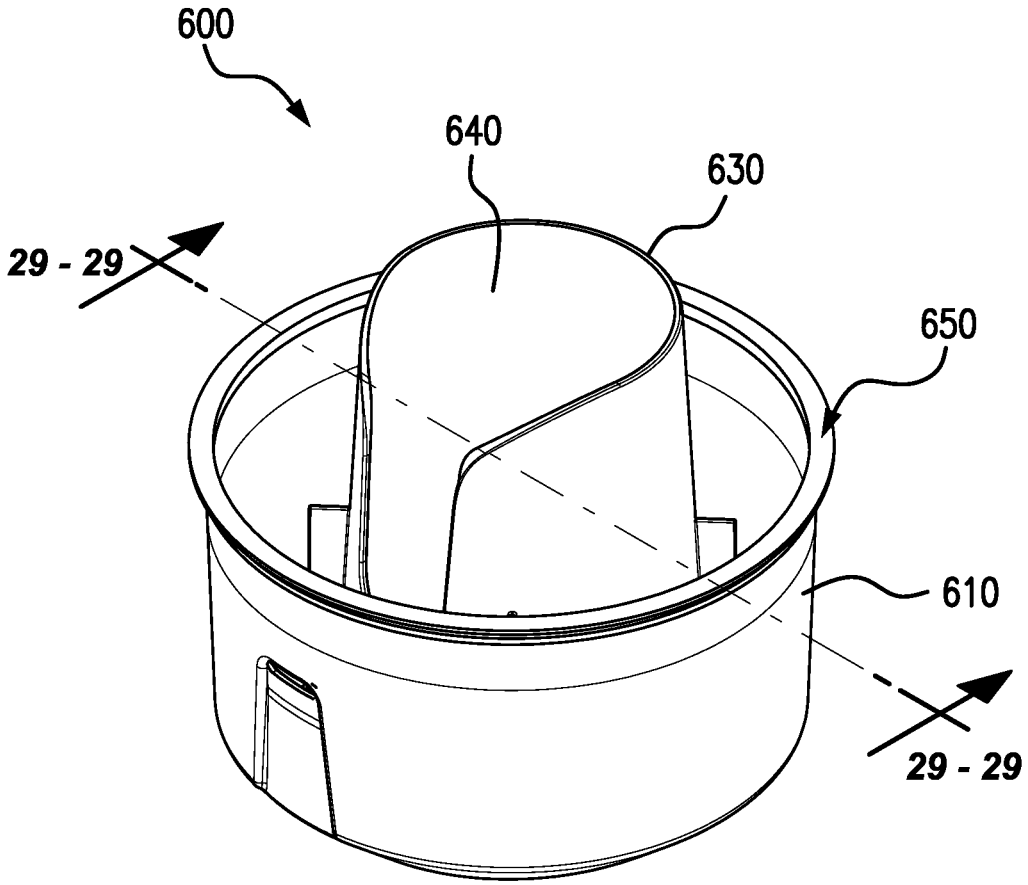
FIG. 28 is a top perspective view of a spout, according to an embodiment.

Referring to FIGS. 19, 21, 25, 26, 28, and 29, for example, in some embodiments, spout 600 may comprise an outer sidewall 610 and a bottom wall 620 integrally connected to outer sidewall 610 to form a cup-shaped body. In some embodiments, spout 600 may comprise a central duct 630 defining a pouring passage 640 opening through the bottom wall 620. In some embodiments, outer sidewall 610 may extend around central duct 630, and bottom wall 620 extends from central duct 630 to outer sidewall 610. In some embodiments, central duct 630 may extend beyond an upper end 612 of outer sidewall 610. In some embodiments, central duct 630 may comprise a cylindrical-shaped wall 632 extending from bottom wall 620 and beyond rim 511 of neck 510 to define pouring passage 640. In some embodiments, as shown in FIGS. 22 and 27, for example, outer sidewall 610 may include a flange 614 projecting in a radial direction at the upper end 612 of outer sidewall 610, whereby upper end 612 and flange 614 extend radially beyond an exterior surface 613 of outer sidewall 610.

In certain embodiments, outer sidewall 610, bottom wall 620, and central duct 630 of spout 600 may be comprised of a first material having a durometer rating in a range between about 10 shore and about 70 shore such that spout 600 has sufficient rigidity to withstand impact forces. In some embodiments, the first material forming spout 600 may include, for example, polyvinyl chloride, high- and low-density polyethylene, polypropylene, acrylic, polystyrene, polycarbonate, polyethylene terephthalate, polyethylene naphthalene and blends of thereof.

Figure 21:
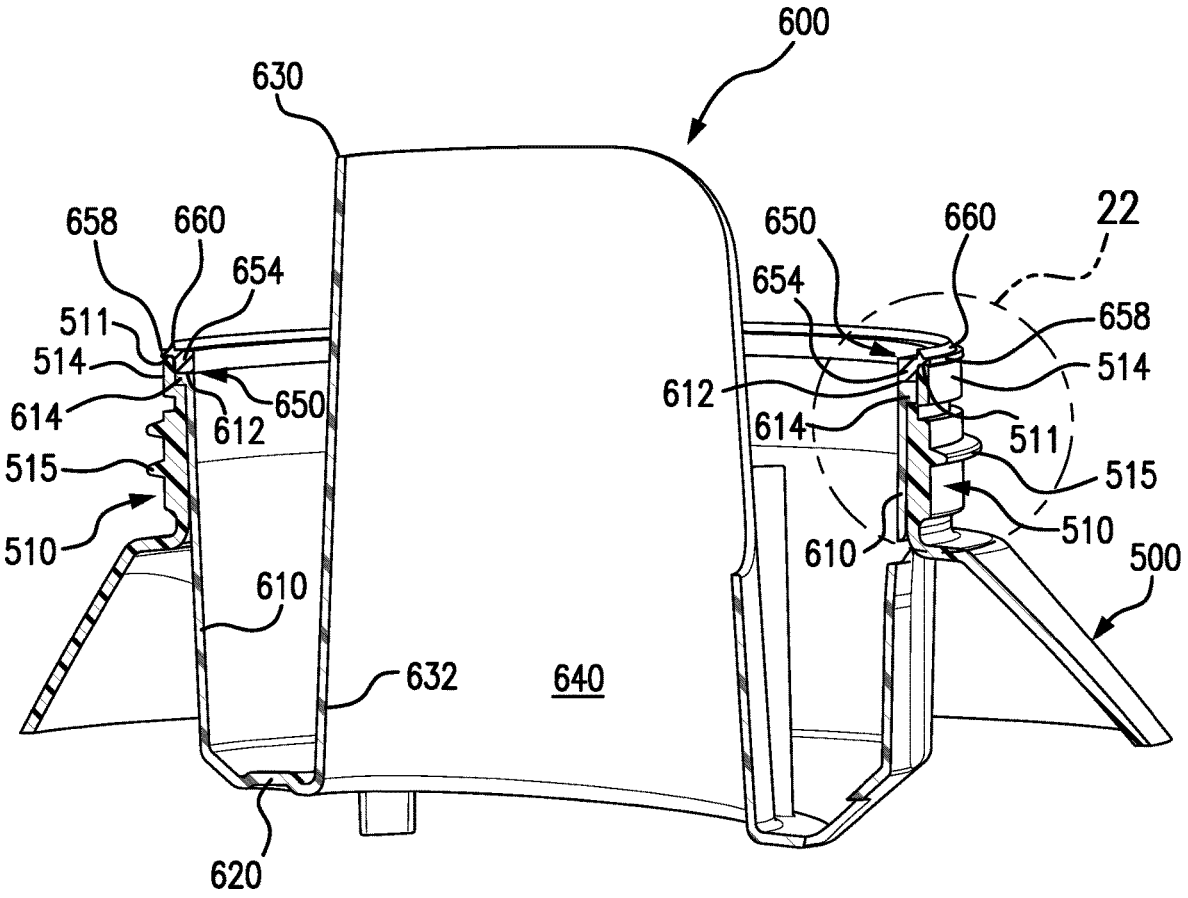
FIG. 21 is a cross-sectional view of a bottle assembly with spout secured to a neck of a bottle taken along a central longitudinal axis of the neck of the bottle, according to an embodiment.
Figure 22:
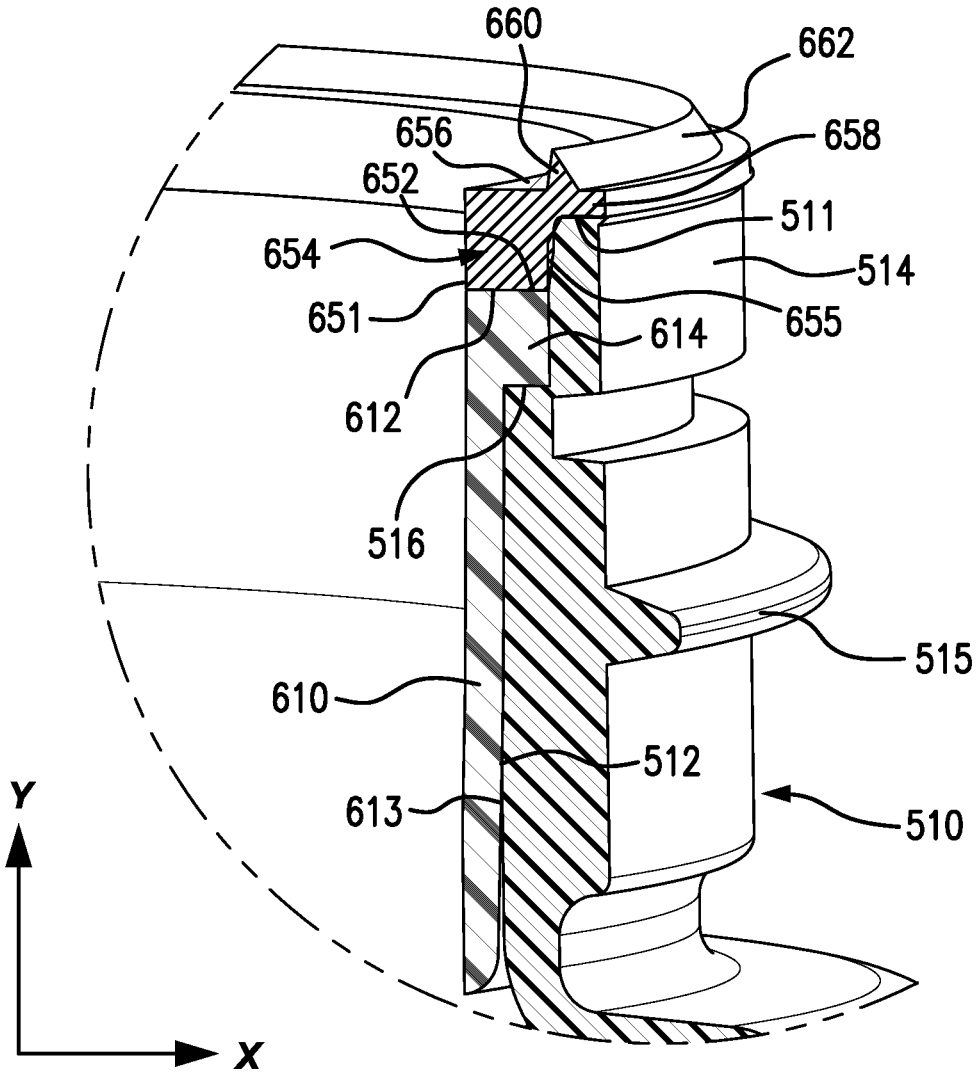
FIG. 22 is an enlarged partial cross-sectional view of the bottle assembly taken along broken line 22 of FIG. 21, according to an embodiment.

Referring to FIGS. 21 and 22, in some embodiments, spout 600 may be configured to be received within neck 510 and secured to bottle 500. For example, when spout 600 is secured to bottle 500, exterior surface 613 of outer sidewall 610 may be disposed against an interior surface 512 of neck 510. In some embodiments, upper end 612 of outer sidewall 610 may be disposed below rim 511 of neck 510. In some embodiments, neck 510 may include a step 516 disposed along interior surface 512 of neck 510, and flange 614 is received on step 516 of neck 510, which provides a stop for spout 600 when initially placed within neck 510 of bottle 500 such that spout 600 is not forced further into bottle 500. Outer sidewall 610 may extend into reservoir 502, where bottom wall 620 may extend radially from a lower end 616 of outer sidewall 610 to partially enclose a lower section of reservoir 502 from opening of neck 510. Wall 632 of central duct 630 may extend beyond rim 511 of neck 510, where pouring passage 640 is in communication with reservoir 502 of bottle 500.

In some embodiments, seal ring 650 may be disposed on upper end 612 of outer sidewall 610 and extending along flange 614 of outer sidewall 610 to provide a seal interface between rim 511 of neck 510 and a portion of cap 700 (e.g., skirt flange 734). In some embodiments, seal ring 650 may be formed from a second material (e.g., a soft conformable material) having a durometer in a range between about 10 shore and about 70 shore such that seal ring 650 can absorb and dissipate shock resulting from impact forces applied against cap 700, thereby improving impact performance and the integrity of bottle assembly 20. In some embodiments, seal ring 650 may include a durometer in a range between about 15 shore and 25 shore, such as, for example, 20 shore. In some embodiments, seal ring 650 can be elastically strained, thinned, or deformed by application of a compressive force to extrude into a void space disposed between the interior surface of skirt 730 and rim 511 of neck 510 when cap 700 and spout 600 are secured to bottle 500, thereby providing a liquid-tight seal. In some embodiments, the second material may include, for example, TPE, a silicon, a rubber-based material, wax, an adhesive, or blends thereof.

In some embodiments, the second material forming seal ring 650 may include a static coefficient of friction slide angle in a range between about 50 degrees and about 70 degrees such as, for example, about 55 degrees and about 65 degrees (based on standards from American Society for Testing and Materials), to provide a balance between torque application and retention of spout 600. For example, if coefficient of friction is too high, seal ring 650 may oppose too much torque as a user is attempting to twist cap 700 off neck 510, rendering it difficult to remove cap 700. If coefficient of friction is too low, seal ring 650 may slip as a user is attempting to twist cap 700 off neck 510, thereby resulting in unwanted rotation of spout 600 such that central duct 630 is not oriented properly with a pouring motion. Accordingly, by having a static coefficient of friction slide angle in a range between about 50 degrees and about 70 degrees seal ring 650 allows cap 700 to be twisted off without substantial force while also providing proper orientation of spout 600. In some embodiments, a predetermined coefficient of friction for seal ring 650 may be achieved through a selection of materials, such as slip agents, resins, and wax, to be blended together.

Figure 30:
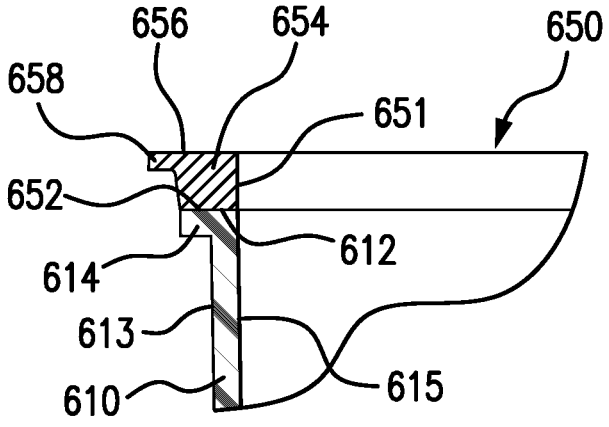
FIG. 30 is an enlarged partial cross-sectional view of a spout taken along broken line 30 of FIG. 29, according to an embodiment.
Figure 31:
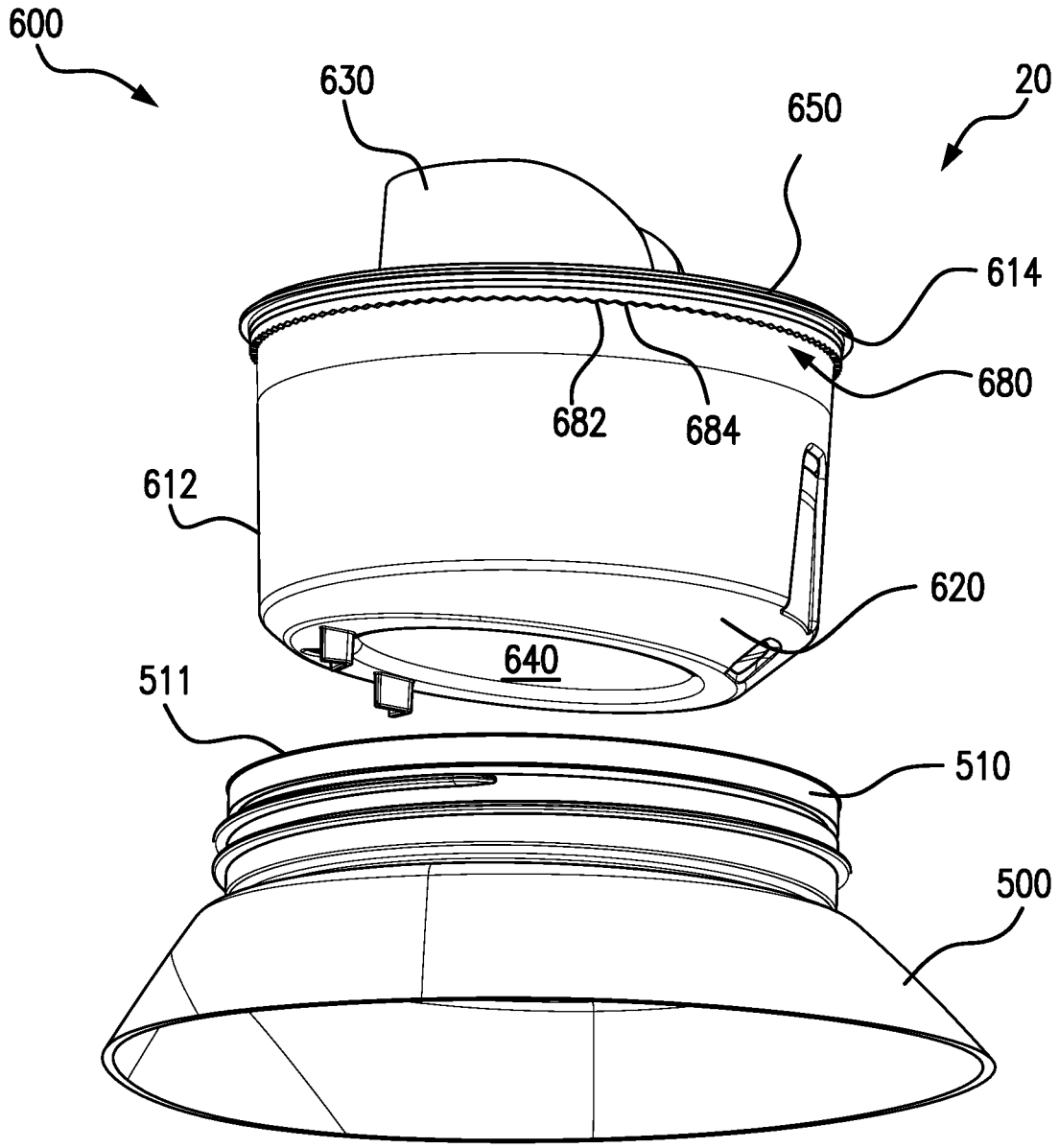
FIG. 31 is an exploded view of a bottle assembly, according to an embodiment.

In some embodiments, seal ring 650 may be integrally attached to upper end 612 of outer sidewall 610 by a molding process such that seal ring 650 and spout 600 form a single element such that spout 600 and seal ring 650 may be placed together simultaneously within neck 510, rather than placing spout 600 and seal ring 650 separately within neck 510 of bottle 500. For example, in some embodiments, outer sidewall 610, bottom wall 620, central duct 630, and seal ring 650 may be injected molded as a single integral element. In some embodiments, the injection molding process for spout 600 and seal ring 650 may include a two-shot injection procedure that includes injecting a first shot of the first material for spout 600 and a second shot of the second material for seal ring 650 into a mold that shapes spout 600 and seal ring 650 accordingly. As shown in FIGS. 22, 27, and 30, for example, the injection molding process allows interior surface 651 of seal ring 650 to be flush with interior surface 615 of outer sidewall 610 and a bottom surface 652 of seal ring 650 to be flush with upper end 612 of outer sidewall 610, such that seal ring 650 extends continuously from flange 614.

In some embodiments, seal ring 650 may be secured to upper end 612 of outer sidewall 610 by other processes. For example, in some embodiments, seal ring 650 may be bonded to upper end 612 by an adhesive, spin welding, over-molding, and/or insert molding, such that seal ring 650 is attached with spout 600.

In some embodiments, as shown in FIGS. 20 and 22, the geometry of seal ring 650 may be configured to provide a seal interface extending both in an axial direction (indicated by arrow Y) along interior surface 512 of neck 510 and a radial direction (indicated by arrow X) along rim 511 of neck 510.

For example, in some embodiments, interior surface 651 and bottom surface 652 of seal ring 650 may define an annular band portion 654 disposed on upper end 612 and extending along flange 614. In some embodiments, annular band portion 654 may be configured to be received within neck 510, and an exterior surface 655 of annular band portion 654 may be press fitted against interior surface 512 of neck 510. In some embodiments, as shown in FIG. 22 for example, an upper surface 656 of annular band portion 654 may be disposed above rim 511 of neck 510 when spout 600 is secured within neck 510 of bottle 500, thereby providing intimate contact between interior surface of skirt 730 (e.g., bottom surface 735 of skirt flange 734), ultimately improving seal reliability between neck 510 of bottle 500 and cap 700.

Figure 29:
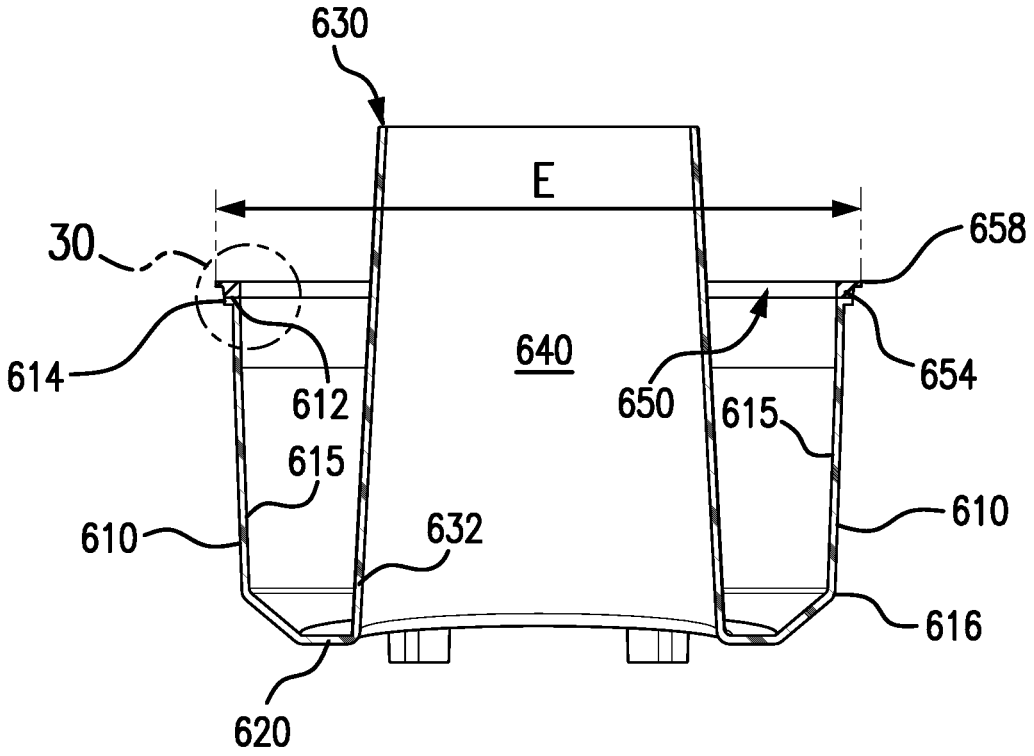
FIG. 29 is a side cross-sectional view of the spout taken along line 29-29 of FIG. 28, according to an embodiment.

In some embodiments, seal ring 650 may include a lip 658 projecting in a radial direction at the upper surface 656 of annular band portion 654 toward exterior of bottle 500. In some embodiments, as shown in FIG. 22, for example, exterior surface 655 of annular band portion 654 and lip 658 may define an L-shaped contour such that exterior surface 655 of annular band portion 654 is pressed against interior surface 512 of neck 510 and lip 658 is received on rim 511 of neck 510. In some embodiments, as shown in FIGS. 26 and 29, seal ring 650 may include an outer diameter E defined between diametrically opposite outer surfaces of lip 658. In some embodiments, the outer diameter E of seal ring 650 can range between about 65 mm and about 70 mm, such as, for example, about 66 mm and about 68 mm. In some embodiments, the outer diameter E of seal ring 650 may be greater than an outer diameter of neck 510 so that that lip 658 is biased radially outward when compressed between neck 510 and skirt 730 of cap 700, thereby compensating for shrinking of spout 600 when received within neck 510 of bottle 500. In some embodiments, the outer diameter E of seal ring 650 is less than an internal diameter F (shown in FIG. 23) measured between diametrically opposite surfaces of rib 736 of skirt 730, such that seal ring 650 does not interfere with interlocking connection between skirt 730 of cap 700 and neck 510 of bottle 500. In some embodiments, when spout 600 is secured within neck 510, lip 658 of seal ring 650 may extend radially beyond an exterior surface 514 of the neck 510 by an overhang distance in a range between about 0.1 mm and about 2.0 mm, while still providing interlocking between thread 515 of neck 510 and rib 736 of skirt 730. In some embodiments, when spout 600 is secured within neck 510, lip 658 of seal ring 650 may not extend radially beyond an exterior surface 514 of the neck 510.

Figure 24:
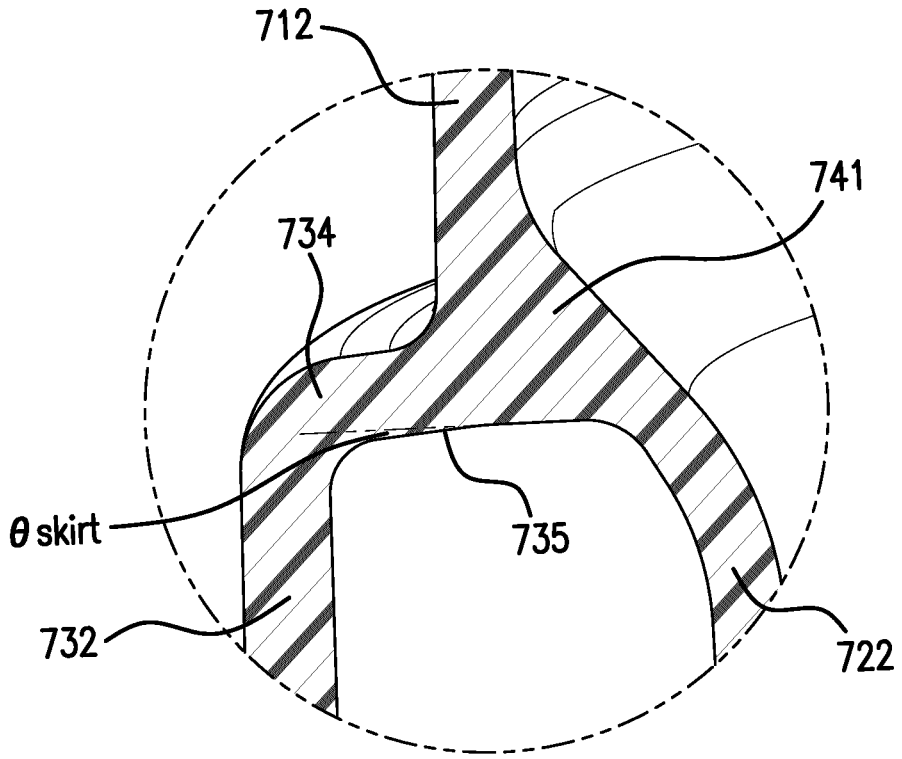
FIG. 24 is an enlarged partial cross-sectional view of the cap taken along broken line 24 of FIG. 23, according to an embodiment.
Figure 25:
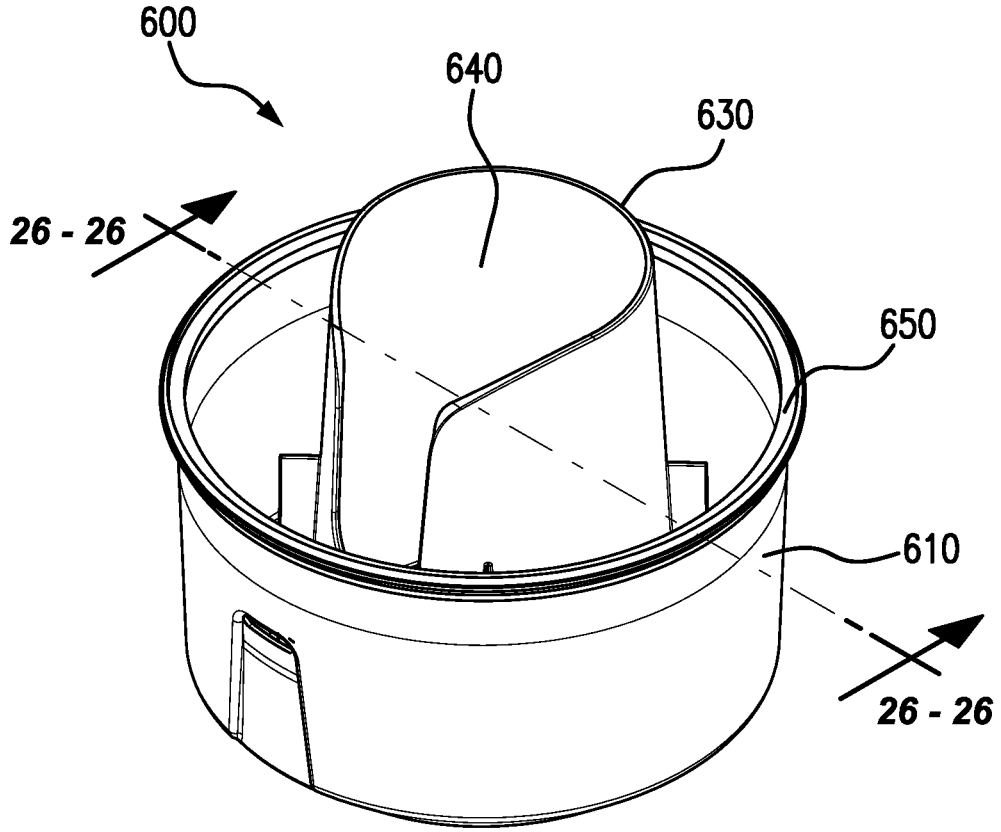
FIG. 25 is a top perspective view of a spout, according to an embodiment.

FIG. 20 shows an enlarged cross-sectional view of bottle assembly 20, in which spout 600 is disposed in neck 510 and cap 700 is secured to bottle 500. In some embodiments, when cap 700 is secured to bottle 500, a bottom surface 735 of skirt flange 734 engages lip 658 of seal ring 650 and upper surface 656 of annular band portion 654 to promote a fluid-tight seal between cap 700 and neck 510, preventing liquid from escaping bottle assembly 20, even when exposed to high impact forces. In some embodiments, with reference to FIGS. 20 and 24, bottom surface 735 of skirt flange 734 may be inclined downward in a direction toward neck 510 at an angle ° skirt (shown in FIG. 24) between about 1° and about 10°, such as, for example, between about 1° and about 5°. By inclining at a small angle instead of extending completely horizontal, bottom surface 735 of skirt flange 734 deflects lip 658 of seal ring 650 both radially outward and downward in an axial direction, rather than deflecting lip 658 only in a downward direction toward bottle 500. Deflection of lip 658 in the radial direction promotes a more reliable fluid-tight seal between neck 510 of bottle 500 and skirt 730 of cap 700.

In some embodiments, as shown in FIGS. 20 and 27, seal ring 650 may include a projection 660 extending from upper surface 656. In some embodiments, projection 660 may define an upper surface 662 inclined in a direction toward the neck 510 of bottle 500. In some embodiments, upper surface 662 of projection 660 may engage bottom surface 735 of skirt flange 734, such that a portion of the seal interface between seal ring 250 and bottom surface 735 of skirt flange 734 is inclined toward neck 510 of bottle 500, rather than extending horizontal. In some embodiments, as shown in FIG. 30, upper surface 656 of seal ring 250 may be substantially flat.

In some embodiments, seal ring 650 can be disposed between neck 510 of bottle 500 and skirt 730 of cap 700, without having spout 600 inserted into neck 510 of bottle 500. In some embodiments, as shown in FIG. 30, seal ring 650 may comprise a height in a range between about 0.5 mm and about 2.5 mm such that skirt 730 of cap 700 may engage seal ring 650 and be secured to neck 510 of bottle 500, either when spout 600 is not inserted into neck 510 or when seal ring 650 is integrated with spout 600 and received together within neck 510 of bottle 500.

Figure 35:
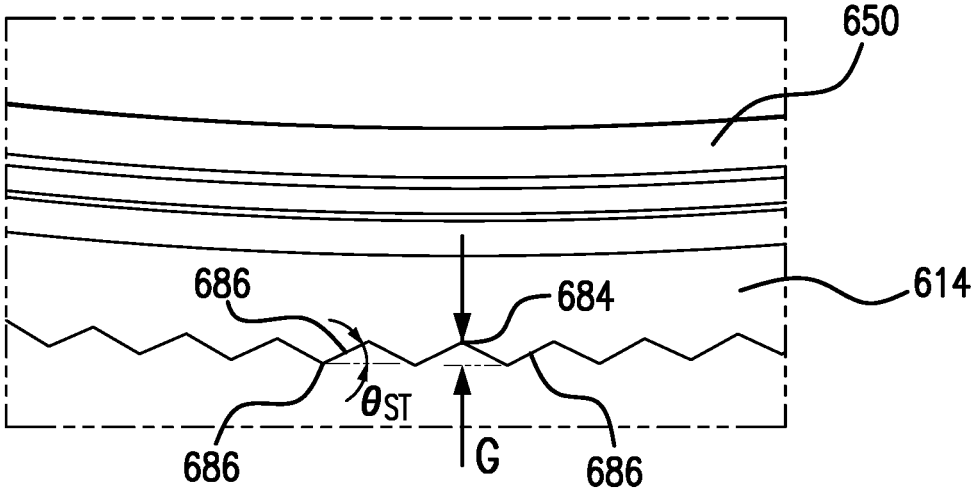
FIG. 35 is a partial detailed view of a spout taken along broken line 35 of FIG. 34, according to an embodiment.

Referring to FIGS. 31-34, in some embodiments, spout 600 may include a plurality of spout teeth 680 extending, for example, from a bottom surface of flange 614 and disposed around a perimeter of outer sidewall 610. As shown in FIG. 35, spout teeth 680 may include a plurality of ridges 682 and a plurality of grooves 684 alternating around the perimeter of the outer sidewall 610. In some embodiments, the plurality of spout teeth 680 may include a total number of teeth in a range between about 10 teeth and about 240 teeth, such as, for example, between about 48 teeth and about 90 teeth, such as, for example, 60 teeth. In some embodiments, the plurality of spout teeth may have a height Gin a range between about 0.25 mm and about 10 mm, such as, for example, between about 0.5 mm and about 1.0 mm. In some embodiments, spout teeth 680 may include a tooth face 686 inclined at an angle $\theta_{ST}$ with respect to a horizontal plane extending parallel to flange 614 in a range between about 2° and about 70° such as, for example between 30° and 45°.

Figure 32:
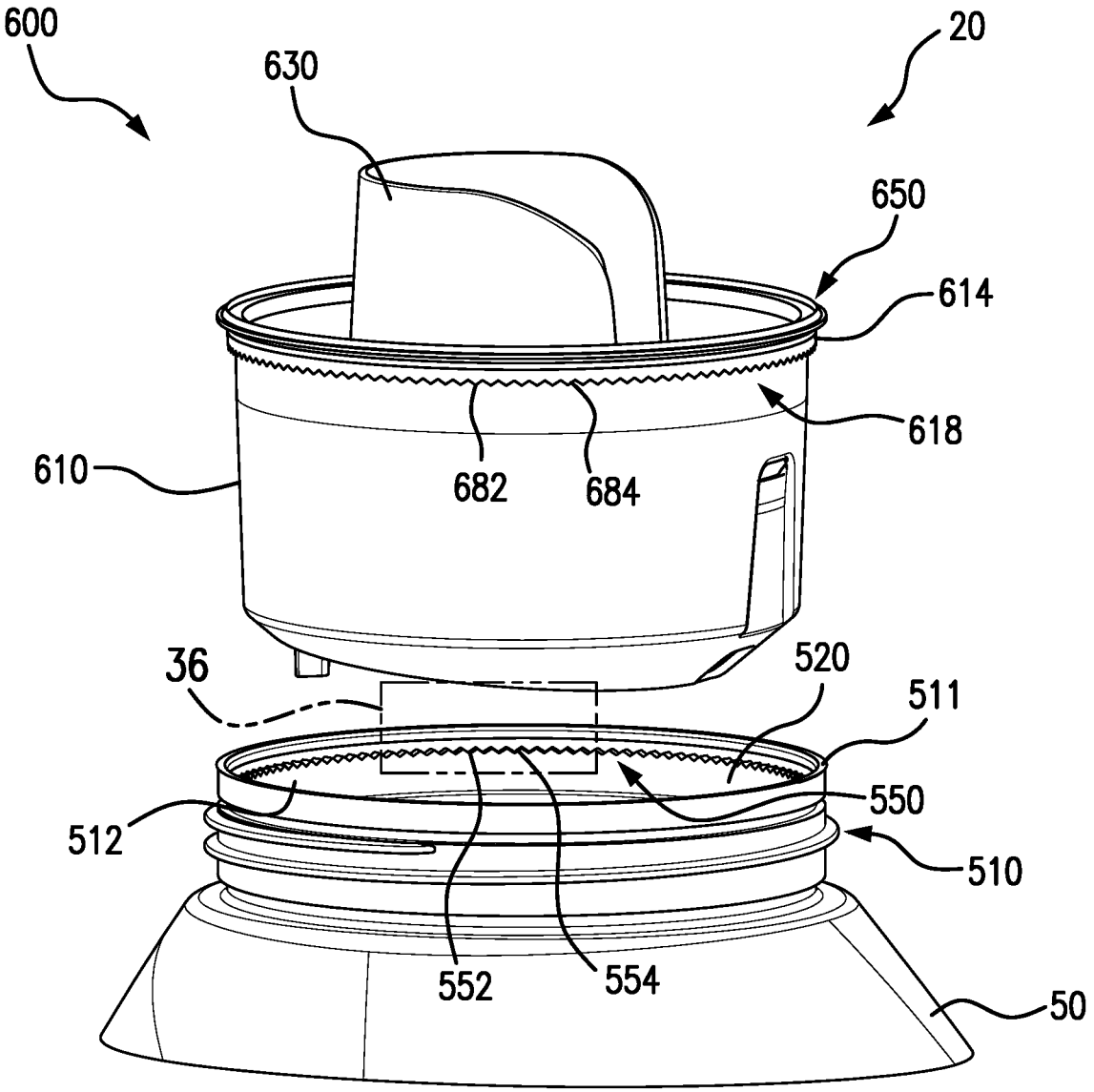
FIG. 32 is an exploded view of a bottle assembly, according to an embodiment.
Figure 33:
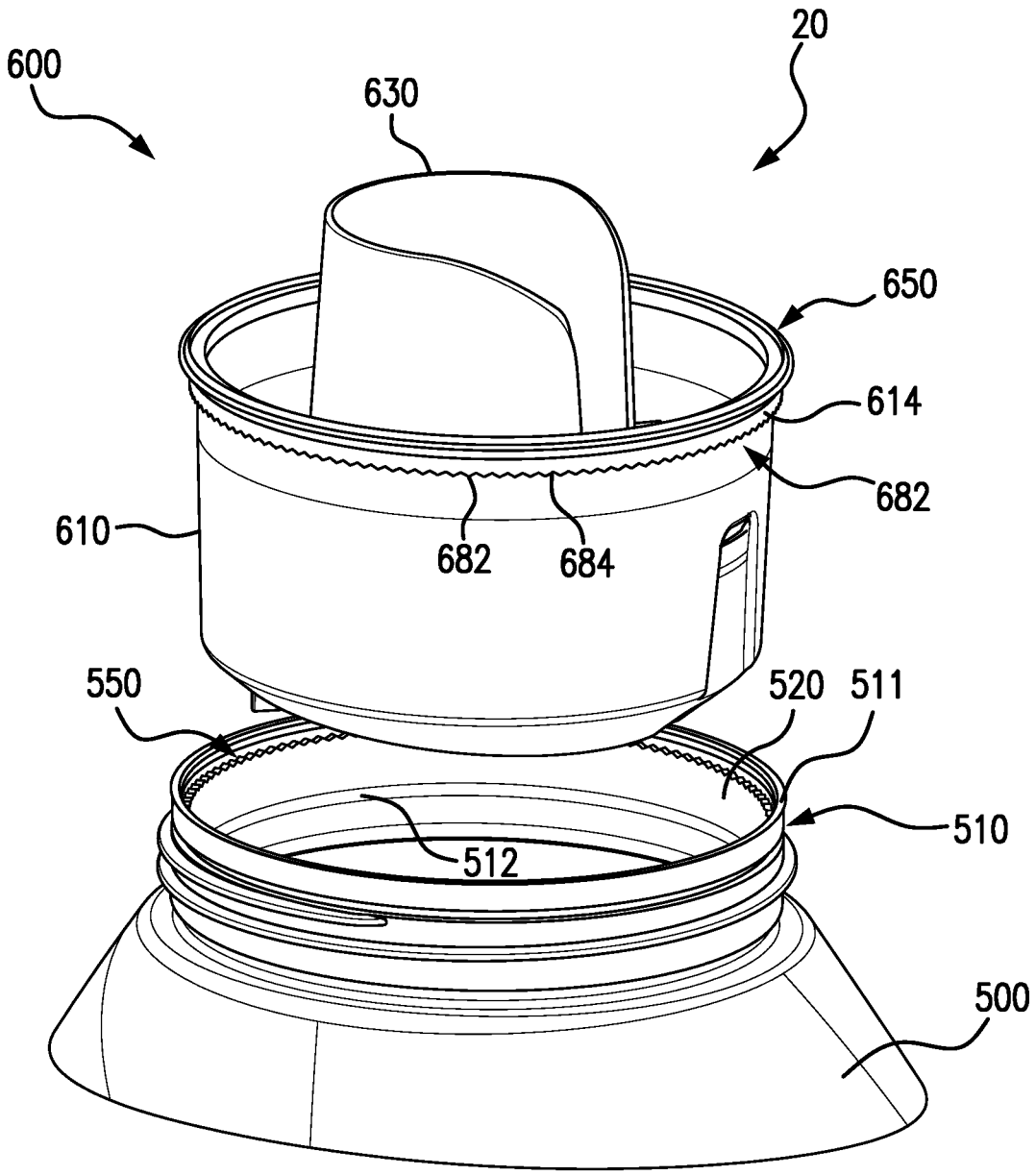
FIG. 33 is an exploded view of a bottle assembly according to an embodiment.
Figure 34:
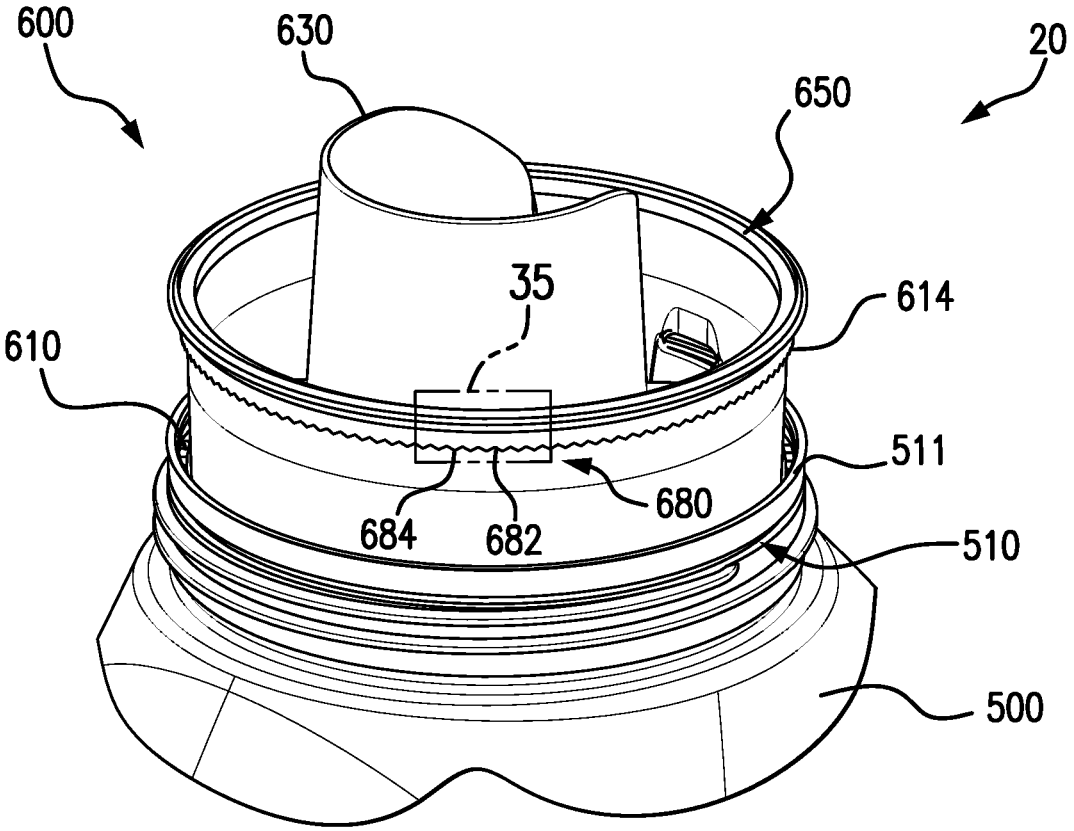
FIG. 34 is a perspective view of a bottle assembly with a spout partially received in a neck of a bottle, according to an embodiment.
Figure 36:
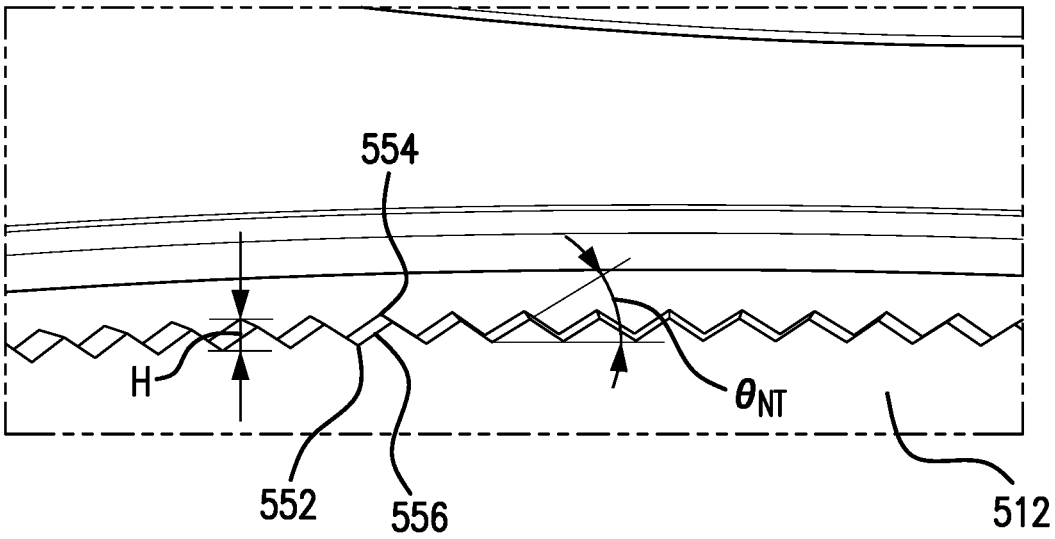
FIG. 36 is a partial detailed view of a neck taken along broken line 36 of FIG. 32, according to an embodiment.

In some embodiments, as shown in FIGS. 32 and 33, neck 510 may include a plurality of neck teeth 550 disposed along interior surface 512 of the neck 510. In some embodiments, the plurality of neck teeth 550 may be configured to couple with spout teeth 680 of spout 600. As shown in FIG. 36, neck teeth 550 may include a plurality of ridges 552 and a plurality of grooves 554 alternating around interior surface 512 of neck 510. In some embodiments, the plurality of neck teeth 550 may include a total number of teeth in a range between about 10 teeth and about 240 teeth, such as for example, between about 48 teeth and about 90 teeth, such as, for example, 60 teeth. In some embodiments, the plurality of neck teeth 550 may have a height H in a range between about 0.25 mm and about 10 mm, such as, for example, about 0.5 mm and about 1.0 mm. In some embodiments, neck teeth 550 may include a tooth face 556 inclined at an angle $\theta_{NT}$ with respect to a horizontal plane extending parallel to rim 511 in a range between about 2° and about 70°.

In some embodiments, when the plurality of spout teeth 680 are coupled to the plurality of neck teeth 550, ridges 682 of spout teeth 680 are received in grooves 554 of the neck teeth 550, and ridges 552 of neck teeth 550 are received in grooves 684 of spout teeth 680, such that neck teeth 550 mesh with spout teeth 680. By coupling with the plurality of neck teeth 550, the plurality of spout teeth 680 prevent spout 600 from being rotated about neck 510 of bottle 500 when torque is applied directly or indirectly to spout 600, thereby providing that spout 600 remains in a fixed position, ultimately providing that central duct 630 is oriented properly for a pouring motion by a user. Accordingly, the coupling between the plurality of spout teeth 680 and neck teeth 550 provide that spout 600 is not rotated as cap 700 is applied to or removed from neck 510 of bottle 500.

It is to be appreciated that the Detailed Description section, and not the Brief Summary and Abstract sections, is intended to be used to interpret the claims. The Summary and Abstract sections may set forth one or more but not all exemplary embodiments as contemplated by the inventors, and thus, are not intended to limit the present embodiments and the appended claims in any way.

The present disclosure has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the inventions that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present disclosure should not be limited by any of the above-described exemplary embodiments, but should be defined only in accordance with the following claims and their equivalents.

What is claimed is:

1. A container assembly, comprising:

a container comprising a neck defining an opening into the container;

a cap removably coupled to the neck, the cap comprising:

an upper cap portion comprising a top and an upper cap sidewall extending around a perimeter of the top, a skirt configured to be received on a rim of the neck, the skirt comprising a skirt sidewall and a skirt flange extending radially between the upper cap sidewall and the skirt sidewall; and a spout disposed in the neck of the container, the spout comprising:

a central duct extending through the opening of the neck and defining a pouring passage in communication with an interior of the container, an outer sidewall extending around the central duct and disposed against an interior surface of the neck, and a seal ring disposed on an upper end of the outer sidewall of the spout and disposed against the neck of the container, wherein the seal ring is disposed against the skirt flange of the cap when the cap is disposed on the container, wherein a bottom surface of the skirt flange is inclined downward in a direction toward the neck of the container at an angle between about 1° and about 10°, and wherein the seal ring is disposed on a distal-most upward facing surface of the upper end of the outer sidewall of the spout when the cap is removed from the container, wherein the seal ring is disposed against the interior surface of the neck of the container when the cap is removed from the container.

2. The container assembly of claim 1, wherein the seal ring comprises an annular band portion and a lip projecting radially from an upper end of the annular band portion, wherein the annular band portion engages the interior surface of the neck of the container and the lip is received on an upper end of the neck.

3. The container assembly of claim 2, wherein the lip comprises a first outer diameter, and the neck of the container comprises a second outer diameter less than the first outer diameter.

4. The container assembly of claim 2, wherein the seal ring comprises a projection extending from an upper surface of the seal ring, and the projection engages the bottom surface of the skirt flange.

5. The container assembly of claim 4, wherein the projection of the seal ring comprises an upper surface inclined in a direction toward the neck of the container.

6. The container assembly of claim 1, wherein the inclined bottom surface of the skirt flange extends to the skirt sidewall, and the seal ring is disposed against the inclined bottom surface of the skirt flange when the cap is disposed on the container.

* * * * *